US005810120A

United States Patent [19]

Jamieson et al.

[11] Patent Number: 5,810,120

[45] Date of Patent: Sep. 22, 1998

[54] ROLLER GUIDE ASSEMBLY FEATURING A COMBINATION OF A SOLENOID AND AN ELECTROMAGNET FOR PROVIDING COUNTERBALANCED CENTERING CONTROL

[75] Inventors: Eric K. Jamieson, Farmington; Dang V. Nguyen, East Hartford; Kelly H. Schaefer, Hartford, all of Conn.

[73] Assignee: Otis Elevator Company, Farmington, Conn.

[21] Appl. No.: 741,751

[22] Filed: Nov. 5, 1996

[51] Int. Cl.[6] ..... B66B 1/34; B66B 7/04

[52] U.S. Cl. ..... 187/292; 187/394; 187/410

[58] Field of Search ..... 187/409, 410, 187/394, 391, 292

[56] References Cited

U.S. PATENT DOCUMENTS

| | | | |
|---|---|---|---|
| 4,770,438 | 9/1988 | Sugasawa et al. | 280/707 |
| 4,892,328 | 1/1990 | Kurtzman et al. | 280/707 |
| 5,086,882 | 2/1992 | Sugahara et al. | 187/95 |
| 5,117,946 | 6/1992 | Traktovenko et al. | 187/95 |
| 5,193,651 | 3/1993 | Shigeta et al. | 187/95 |
| 5,329,077 | 7/1994 | Skalski et al. | 187/133 |
| 5,367,132 | 11/1994 | Skalski et al. | 187/393 |
| 5,439,075 | 8/1995 | Skalski et al. | 187/410 |
| 5,524,730 | 6/1996 | Roberts | 187/292 |
| 5,535,853 | 7/1996 | Skalski | 187/410 |

FOREIGN PATENT DOCUMENTS

| | | | |
|---|---|---|---|
| 0467673 | 1/1992 | European Pat. Off. | B66B 11/02 |
| 323185 | 1/1991 | Japan | B66B 11/02 |
| 351280 | 3/1991 | Japan | B66B 5/02 |
| 351281 | 3/1991 | Japan | B66B 5/02 |
| 351285 | 3/1991 | Japan | B66B 11/02 |
| 3115076 | 5/1991 | Japan | B66B 1/06 |
| 6336383 | 12/1994 | Japan | B66B 7/04 |
| 710418 | 1/1995 | Japan | B66B 7/04 |
| 72457 | 1/1995 | Japan | B66B 7/04 |
| 8133640 | 5/1996 | Japan | B66B 11/02 |
| 2262932 | 7/1993 | United Kingdom | B66B 7/02 |

OTHER PUBLICATIONS

"Attitude Control System of a Super–high Speed Elevator Car Based on Magnetic Guides" by H. Inaba et al., IEEE IECON '94, Bologna, Italy, Sep. 5–9, 1994.

*Primary Examiner*—Robert Nappi
*Attorney, Agent, or Firm*—Francis J. Maguire, Jr.

[57] ABSTRACT

The present invention provides a roller guide assembly for controlling the position of an elevator car in relation to guide rails of an elevator hoistway in an elevator system. The roller guide assembly includes at least one electromagnet means and at least one solenoid means. The at least one electromagnet means responds to an elevator car control signal from an elevator car controller, for providing at least one electromagnet force to adjust the position of the elevator car in relation to the guide rails of the elevator hoistway. The at least one solenoid means responds to the elevator car control signal, for providing at least one solenoid force that counterbalances said at least one electromagnet force for adjusting the position of the elevator car in relation to the guide rails of the elevator hoistway.

21 Claims, 14 Drawing Sheets

Microfiche Appendix Included
(1 Microfiche, 21 Pages)

ROLLER GUIDE ASSEMBLY FEATURING A COMBINATION OF A SOLENOID AND AN ELECTROMAGNET FOR PROVIDING COUNTERBALANCED CENTERING CONTROL

MICROFICHE APPENDIX

This application contains a Microfiche Appendix having a program listing with 21 pages on one Microfiche.

COPYRIGHT PROTECTION NOTICE

A portion of the disclosure of this patent application contains material which is subject to copyright protection. The copyright owner has no objection to the facsimile reproduction by anyone of the patent document or patent disclosure, as it appears in the Patent and Trademark Office patent file or records, but otherwise reserves all copyright and trademark rights whatsoever.

BACKGROUND OF THE INVENTION

1. Field of the Invention

The present invention relates generally to an elevator control system, and more particularly to an elevator control system for controlling the position of an elevator car in relation to guide rails of an elevator hoistway.

2. Description of the Prior Art

Elevator systems for controlling the position of an elevator car in relation to guide rails of an elevator hoistway are known in the art. For example, U.S. Pat. No. 5,117,946 shows and describes an elevator system for an active roller guide having a telescoping ball screw adjustment device (also known as a worm gear) for providing centering control. (See U.S. Pat. No. 5,117,946, FIG. 5, reference numeral 52.) The telescoping ball screw adjustment device is controlled by an electric motor and adjusts the force of a coil spring applied on a roller guide for centering the elevator car in relation to the guide rails of the elevator hoistway. The subject matter of U.S. Pat. No. 5,117,946 is hereby incorporated by reference.

However, the telescoping ball screw adjustment device in U.S. Pat. No. 5,117,946 has some disadvantages, such as high ratio gear boxes, brushless DC motors, brakes, clutches as well as complex control circuitry, which is very expensive in terms of weight, cost and reliability. For instance, the high ratio gears in the telescoping ball screw adjustment actuator device and the brushless DC motor for driving the telescoping ball screw adjustment actuator device may require regular time-consuming and expensive maintenance which is further exacerbated when an active roller guide wheel assembly is located underneath the elevator car. The brushless DC motor also requires complex control circuitry. The high ratio gear boxes and brushless DC motor may also be unreliable over long-term continuous use.

DISCLOSURE OF THE INVENTION

The present invention provides a unique roller guide assembly for an elevator system for controlling the position of an elevator car in relation to guide rails of an elevator hoistway.

In its broadest sense, the roller guide assembly includes at least one electromagnet means and at least one solenoid means. Then at least one electromagnet means responds to an elevator car control signal from an elevator car controller, for providing at least one electromagnet force to adjust the position of the elevator car in relation to the guide rails of the elevator hoistway. Then at least one solenoid means responds to the elevator car control signal, for providing at least one solenoid force that counterbalances said at least one electromagnet force for adjusting the position of the elevator car in relation to the guide rails of the elevator hoistway. In effect, at least one electromagnet means provides a fine adjustment of the position of the elevator car in relation to the guide rails of the elevator hoistway, and the at least one solenoid force provides a coarse adjustment of the position of the elevator car in relation to the guide rails of the elevator hoistway.

In one embodiment, the roller guide assembly also includes at least one coil spring that responds to at least one solenoid force, for providing at least one coil spring force for adjusting the position of the elevator car in relation to the guide rails of the elevator hoistway. The sensed elevator car signal may include information about the position and/or acceleration of the elevator car in relation to the guide rails of the elevator hoistway. The control of the position of the elevator car in relation to the guide rails of the elevator hoistway includes either side-to-side centering control, front-to-back centering control, or both. Then at least one electromagnet also responds to the elevator car control signal, for providing then at least one electromagnet force to control the vibration between the roller (also known as guide wheel) of the elevator car and a guide rail of the elevator hoistway during the control of the position of the elevator car in relation to the guide rails of the elevator hoistway.

One important advantage of using a solenoid for centering control is that it requires significantly less time-consuming and expensive maintenance, in effect having a much longer service life span. The solenoid does not require complex circuitry and is also inherently much more reliable over long continuous use.

Other advantages will become apparent to those skilled in the art from the following detailed description read in conjunction with the appended claims and drawings attached hereto.

BRIEF DESCRIPTION OF THE DRAWINGS

The drawings, not drawn to scale, include.

BEST MODE FOR CARRYING OUT THE INVENTION

Figure 1:
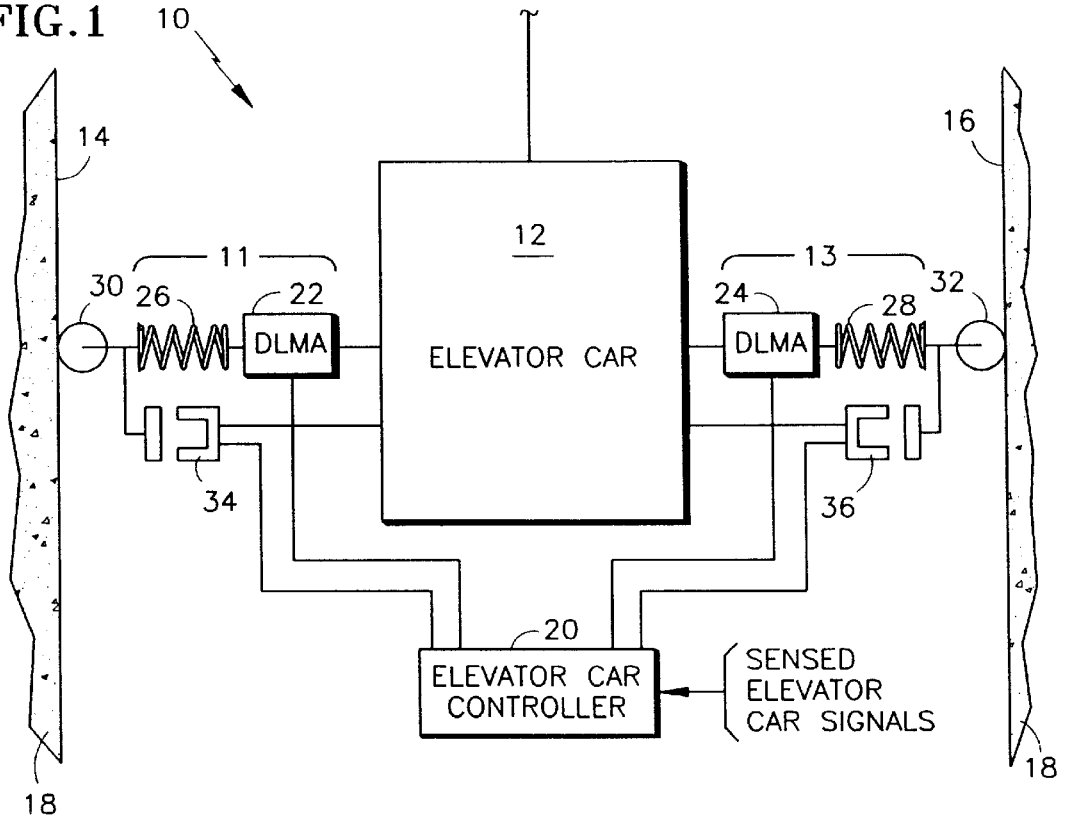
FIG. 1 is a simplified block diagram of an actuator in an elevator guidance system for an active roller guide application.

FIG. 1 shows an elevator system generally indicated as 10 for controlling the horizontal position of an elevator car 12 in relation to guide rails 14, 16 of an elevator hoistway 18.

As shown, the elevator system 10 includes an elevator car controller 20 and active roller guide assemblies 11, 13. Each active roller guide assembly 11, 13 has solenoid assemblies 22, 24. The elevator car controller 20 responds to sensed elevator car signals with information about the position of the elevator car 12 in relation to the guide rails 14, 16 of the elevator hoistway 18, and provides elevator car control signals with information about the control of the position of the elevator car 12 in relation to the guide rails 14, 16 of the elevator hoistway 18. The solenoid assemblies 22, 24 respond to the elevator car control signals, by providing solenoid forces for adjusting the position of the elevator car 12 in relation to the guide rails 14, 16 of the elevator hoistway 18. In the elevator system, the control of the horizontal position of the elevator car 12 in relation to the guide rails 14, 16 of the elevator hoistway 18 includes either side-to-side centering control, front-to-back centering control, or both.

Each roller guide assembly 11, 13 also includes linear coil springs 26, 28 that respond respectively to the solenoid forces, for providing linear coil spring forces for adjusting the horizontal position of the car 12 in relation to the guide rails 14, 16 of the elevator hoistway 18.

Each roller guide assembly 11, 13 also includes electromagnets 34, 36 that respond to the elevator car control signal, for providing electromagnet forces to control the position of the elevator car 12 via rollers 30, 32 in relation to the guide rails 14, 16 of the elevator hoistway 18, in effect providing a dual control function, as discussed in detail below with respect to FIGS. 10–13. In effect, the electromagnets 34, 36 provide a fine position control and the solenoid assemblies 22, 24 provide a coarse position control. Moreover, the electromagnets 34, 36 may also respond to the elevator car control signal, by providing electromagnet forces to control the vibration of the car transmitted to the car, e.g. by the rollers 30, 32 riding on respective guide rails 14, 16 of the elevator hoistway 18 and due to the bumps in the rail joints.

The sensed elevator car signals shown in FIG. 1 are provided from a typical elevator car sensing means which is known in the art, including that shown and described in U.S. Pat. No. 5,117,946, hereby incorporated by reference. The sensed elevator car signals can include information about the position and/or acceleration of the elevator car in relation to the guide rails of the elevator hoistway. In the prior art, usually the sensed position signal is used in a low frequency car centering control loop for controlling a relatively high-force but slow acting actuator while the sensed acceleration signal is used in a higher frequency control loop for controlling a relatively low-force but fast-acting actuator, such as an electromagnet.

The elevator car controller 20 for providing the side-to-side centering control, the front-to-back centering control, or both, as well as vibration control is shown and described below with respect to FIGS. 10–13. In general, the side-to-side centering control, the front-to-back centering control, or both, adjusts the position of the elevator car 12 in relation to the guide rails 14, 16 of the elevator hoistway 18, and also with the help of the electromagnet, as described below. The vibration control, also by means of the electromagnet, controls the vibration of the car transmitted by each roller 30, 32 of the elevator car 12 chiefly due to rail irregularities in a respective guide rail 14, 16 of the elevator hoistway 18 at the same time as assisting in the control of the centering of the elevator car 12 in relation to the guide rails 14, 16 of the elevator hoistway 18. However, the scope of the invention is not intended to be limited to any particular elevator car controller for providing the side-to-side centering control, the front-to-back centering control, or both, as well as for providing vibration control.

Figure 2:
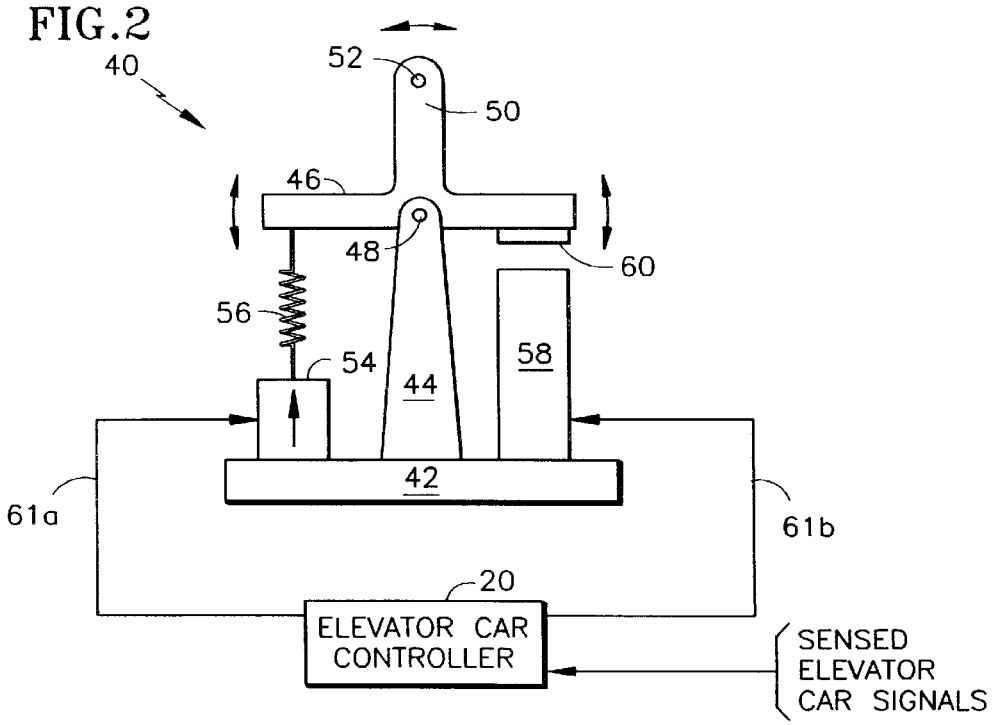
FIG. 2 is a simplified actuator diagram.

FIG. 2 shows a simplified diagram of a roller guide assembly generally indicated as 40 for the purpose of discussing the basic operation of each roller guide assembly 11, 13 of FIG. 1. As shown, the actuator assembly 40 includes a solenoid and magnet base 42 having a pivot support 44 mounted thereon. The actuator assembly 40 also includes a pivot bar 46 mounted on the pivot support 44 about a pivot axis 48, and a roller arm 50 mounted on the pivot bar 46 with a roller axis 52. The actuator assembly 40 also includes a solenoid 54, a spring 56, an electromagnet 58 and a ferromagnetic plate 60. The actuator assembly 40 is responsive to control signals from the elevator car controller 20 that is in turn responsive to sensed elevator car signals. The control signals include an elevator car controller signal on a line 61*a* to the solenoid 54 to control the coarse position of the elevator car 12 in relation to the guide rails 14, 16 of the elevator hoistway 18, and an elevator car controller signal on a line 61*b* to the electromagnet 58 to control the vibration and/or the fine position of the elevator car 12 via rollers 30, 32 in relation to the guide rails 14, 16 of the elevator hoistway 18, consistent with that described above with respect to FIG. 1.

Figure 3:
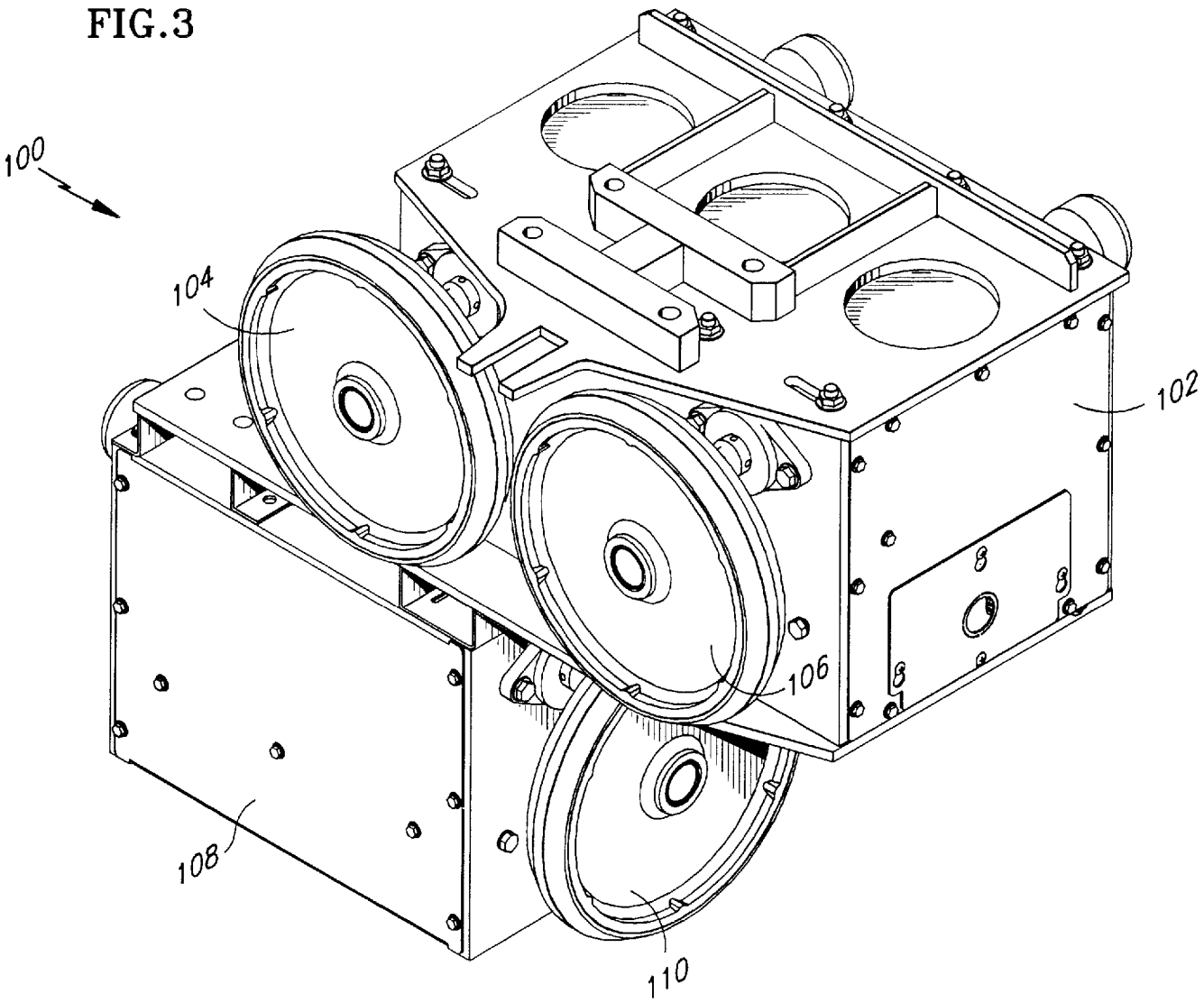
FIG. 3 is a perspective view of an elevator car roller guide assembly cluster 100 of the present invention.

FIG. 3 shows an embodiment of an elevator car guidance assembly cluster of the present invention, generally indicated by the reference numeral 100. The elevator car guidance assembly cluster 100 includes two front-to-back active roller guide assemblies generally indicated as 102 for controlling front-to-back rollers 104, 106 with respect to one of the guide rails 14, 16. The elevator car guidance assembly cluster 100 also includes a side-to-side active roller guide assembly generally indicated as 108 for controlling a side-to-side roller 110 with respect to one of the guide rails 14, 16. As a person skilled in the art would appreciate, an elevator car would typically have one guidance assembly cluster 100 mounted on each side at the bottom of the elevator car, and may also have one guidance assembly cluster 100 mounted on each side at the top of the elevator car, for a total of four guidance assembly clusters, although the top of the elevator car may instead use purely passive roller guide assemblies of the prior art. The scope of the invention is not intended to be limited to an elevator system having a particular number or placement of guidance assembly clusters 100 in the elevator system. For the purpose of describing the invention, a complete description of the side-to-side active roller guide assembly 108 is provided below in detail in FIGS. 4–9. With an understanding of the side-to-side active roller guide assembly 108, any person skilled in the art would appreciate the details of the front-to-back active roller guide assembly 102, which is not shown or described in the same detail.

Figure 4:
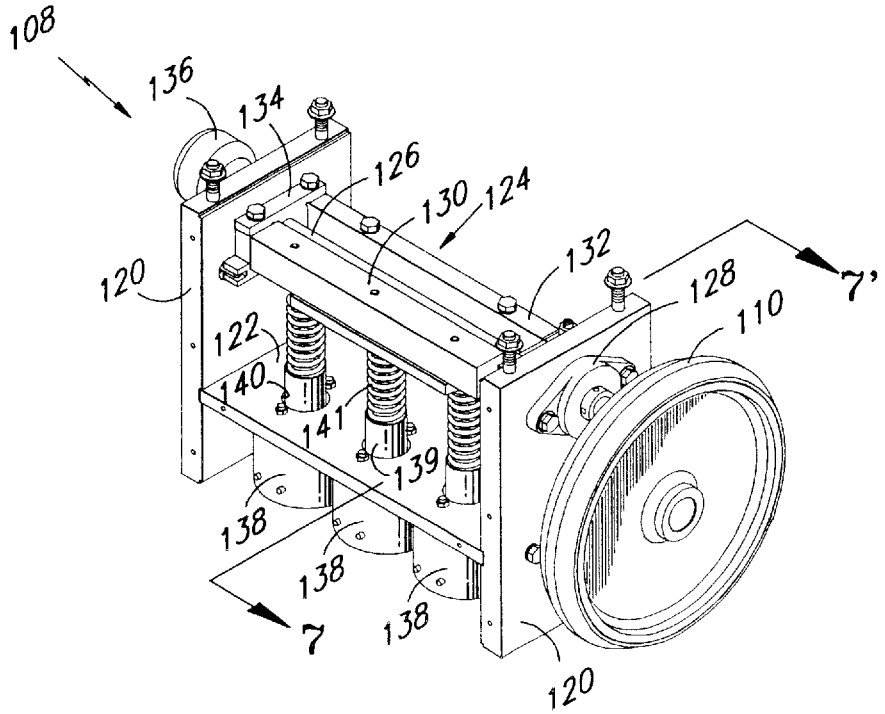
FIG. 4 is a perspective view of a side-to-side roller guide assembly 108 shown in FIG. 3.

FIG. 4 shows the side-to-side active roller guide assembly 108 in greater detail, and includes two end plates 120 attached to each end of a main support plate 122. A shaft assembly 124 is supported between the end plates 120 for pivotal movement and includes a shaft 126 (see also FIG. 6). The shaft 126 extends through both end plates 120 and is supported at both ends by end plate bearings 128 which are attached to the outside of each end plate 120. The shaft assembly 124 also includes a pivot pin support beam 130 and a magnet iron support beam 132 which are both mounted between pivotally-mounted plates 134, adjacent and parallel to the shaft 126. A safety plug 136 is mounted on the end of the shaft 126 opposite to the guide wheel 110 to protect the end of the shaft 126 and prevent injury to personnel.

The side-to-side roller guide assembly 108 also includes three solenoids 138 mounted to the bottom of the main support plate 122. The solenoids 138 are located directly beneath the pivot pin support beam 130 and are arranged in a line parallel to the shaft 126. Lower spring seats 139 are mounted directly on top of each solenoid 138 and protrude through solenoid apertures 140 (see FIG. 6). Compression springs 141 are seated on top of each lower spring seat 139, perpendicular to the main support plate 122 and directly beneath the pivot pin support beam 130. In one embodiment of the present invention, all three solenoids 138 are the same and all three compression springs 141 within the side-to-side assembly 108 have the same spring constant to provide equal spring force. In one embodiment, all three solenoids 138 may be separately actuated to produce a respective 184 Newton force, and all three compression springs 141 have a combined spring constant of 26 Newtons per millimeter. In operation, when one solenoid 138 is actuated a 184 Newton force is applied on a respective compression spring 141; when two solenoids 138 are actuated a 184 Newton force is applied on two respective compression springs 141, and when three solenoids 138 are actuated a 184 Newton force is applied on three respective compression springs 141. However, any person skilled in the art would appreciate that the solenoid force or the spring constant may be changed without departing from the scope of the present invention.

Figure 5:
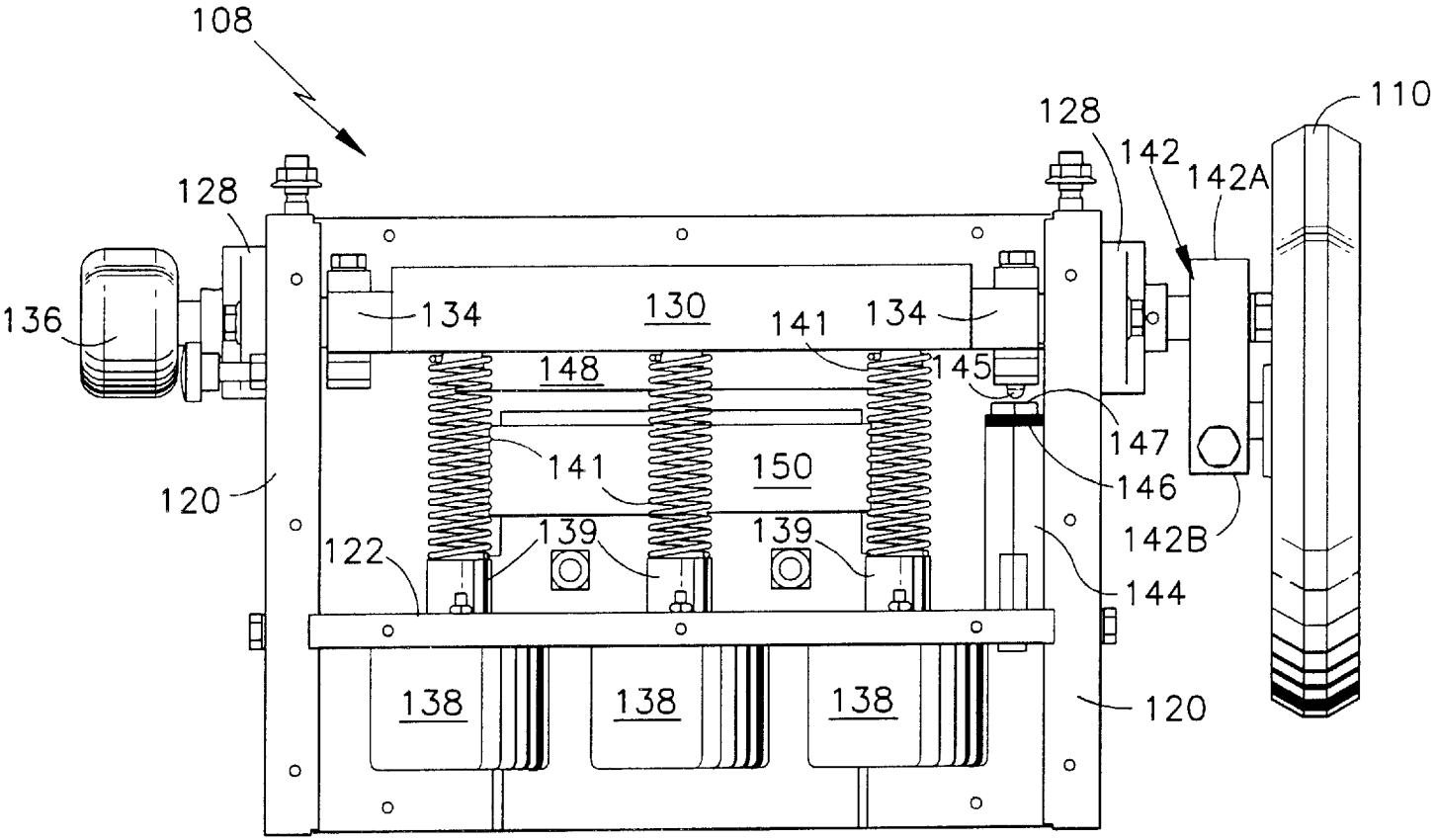
FIG. 5 is a side view of the side-to-side roller guide assembly 108 shown in FIG. 3.

FIG. 5 shows the side-to-side roller guide assembly 108 in further detail from a side view. The side-to-side roller guide assembly 108 also includes a lever 142 having an upper end 142A and a lower end 142B (see also FIG. 6). The upper end 142A is attached to one end of the shaft 126, while the lower end 142B supports the guide wheel 110. The lever 142 converts rotary motion of the shaft assembly 124 into translational movement of the guide wheel 110 so that the guide wheel 110 may be held in contact with the guide rail (see FIG. 1). The side-to-side roller guide assembly 108 also includes a hard stop 144 and a hard stop pin 145 to prevent over-rotation of the shaft assembly 124. (See also FIG. 9.) The hard stop 144 includes conical spring washers 146 located between a contact surface 147 and the hard stop 144 for cushioning any contact between the hard stop pin 145 and the contact surface 147.

Figure 6:
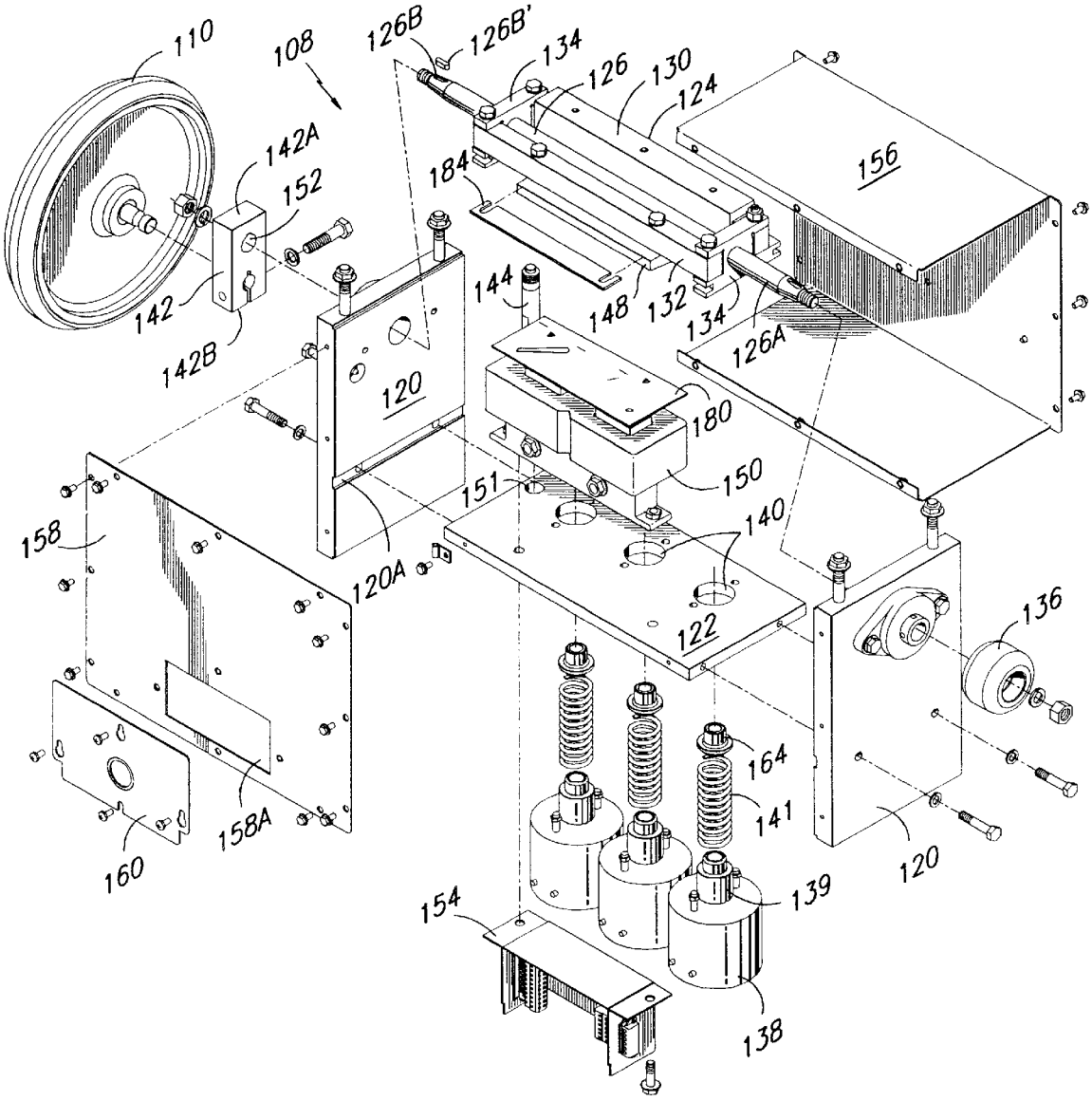
FIG. 6 is an exploded view of the side-to-side roller guide assembly 108 shown in FIGS. 3–5.

A magnet iron 148 is mounted to the magnet iron support beam 132 (FIG. 4) directly above an electromagnet 150 which is mounted to the main support plate 122, for providing an attractive magnetic force with respect to the magnetic iron 148, as best seen in FIG. 6.

FIG. 6 is an exploded view of the side-to-side assembly 108. Each of the end plates 120 includes support grooves 120A for supporting the main support plate 122. In addition, the main support plate 122 includes a hard stop aperture 151 into which the hard stop 144 is mounted. The shaft 126 has two shaft ends 126A, 126B. Each shaft end 126A, 126B is tapered and dimensioned to fit within a nonlocking tapered bore 152 in lever 142. Each shaft end 126B includes a key slot (unlabelled) for receiving an alignment key 126B', provided to align the lever 142 with the shaft 126. A safety plug 136 is mounted to the shaft end 126A. In addition, the side-to-side roller assembly 108 also includes a junction box assembly 154 for providing the necessary electrical connections for the side-to-side roller guide assembly 108.

The side-to-side roller guide assembly 108 also includes a main cover 156 and a side cover 158 for protecting it from undesirable elements, like dirt and dust. The side cover 158 includes an access aperture 158A which is covered by an access panel 160 for accessing the junction box assembly 154.

Figure 7:
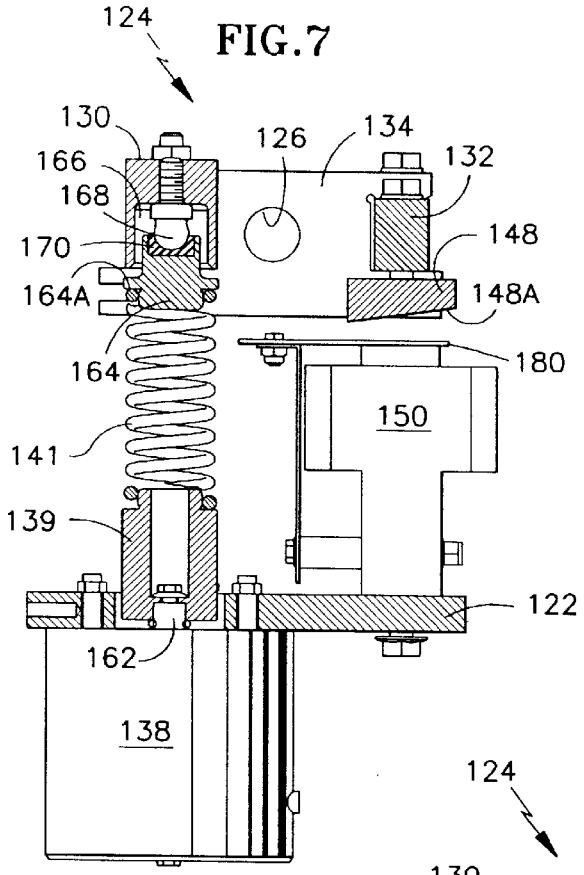
FIG. 7 is a partial cross sectional view of the side-to-side roller guide assembly 108 shown in FIG. 4 along lines 7–7'.

FIG. 7 shows a view of the solenoid assembly and the electromagnet assembly. As shown, each solenoid 138 includes a solenoid shaft 162 which steps up and down vertically as the solenoid 138 is energized and de-energized. Each solenoid 138 has a lower spring seat 139 coupled to the solenoid shaft 162 that supports and retains the compression spring 141. An upper spring seat 164 is mounted on top of each compression spring 141 and includes a flange 164A for retaining the compression spring 141.

The pivot pin support beam 130 includes a cavity 166. A spherical pivot pin 168 is mounted through the pivot pin support beam 130 and held in contact with a spherical socket 170 formed in the upper spring seat 164. The cavity 166 is shaped and dimensioned so that the pivot pin support beam 130 overlaps the upper spring seat 164 and holds it in place as the shaft assembly 124 rotates. This arrangement maintains the pivot pin support beam's 130 smooth continuous contact with the upper spring seat 164 as the shaft assembly 124 rotates.

As shown, the electromagnet 150 is mounted directly to the main support plate 122. The magnet iron 148 is mounted to the magnet iron support beam 132 which in turn is connected between the pivotally-mounted plates 134. The magnet iron 148 includes an angled bottom surface 148A which becomes aligned parallel to the top of the electromagnet 150 as the shaft assembly 124 pivots. A gap sensor (not shown) is mounted in a cavity within a printed circuit board 180 that is mounted directly on top of the electromagnet 150. The gap sensor is arranged in an airgap between the electromagnet 150 and the magnet iron 148 for sensing the flux density in the airgap between the electromagnet 150 and the magnet iron 148 to provide a sensed elevator car position signal to the elevator car controller 20 in FIG. 1. The magnet iron 148 is typically made of iron, and the magnet iron support beam 132 is typically made from a non-magnetic attracting material such as aluminum, although the scope of the invention is not intended to be limited to any particular materials. Moreover, the scope of the invention is not intended to be limited to only an embodiment having compression springs 141 and attractive electromagnets 150. For example, as any person skilled in the art would appreciate, if the positions of the solenoid actuator and the electromagnet were reversed with respect to the side-to-side guide wheel 110, then expansion springs in combination with repulsive electromagnets could be used.

Figure 8:
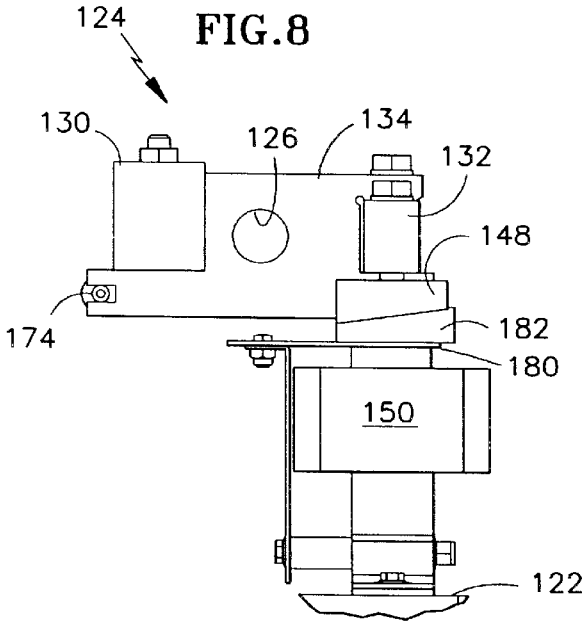
FIG. 8 is a view of the electromagnet gap calibration shown in FIG. 7.
Figure 9:
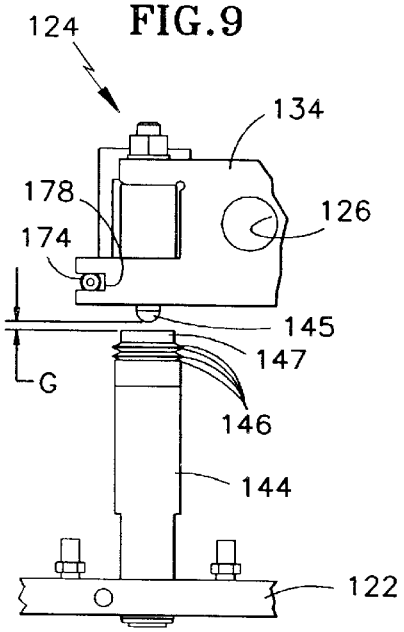
FIG. 9 is a view of the hard stop gap calibration shown in FIG. 5.

FIGS. 8–9 show how the side-to-side roller guide assembly is calibrated. As shown, a calibration pin 174 is inserted into a calibration pin slot 178 provided at the ends of the pivotally-mounted plate 134. The calibration pin 174 locks the shaft assembly 124 into a horizontal position so that it cannot move. In this position, a calibration wedge 182 is inserted between the electromagnet 150 and the magnet iron 148 so that magnet shims 184 (see FIG. 6) can be inserted to set the proper location of the magnet iron 148. The setting of the magnet iron 148 position is typically done during the manufacturing and assembly process at the manufacturer but may of course be done at any other time that it is necessary.

In FIG. 9, the calibration pin 174 also performs the function of setting the hard stop gap. For example, once the calibration pin 174 has been properly installed, the shaft assembly 124 cannot pivot. Accordingly, a hard stop gap distance indicated by the letter "G" can be set by adjusting the depth of the hard stop pin 145.

Figure 10:
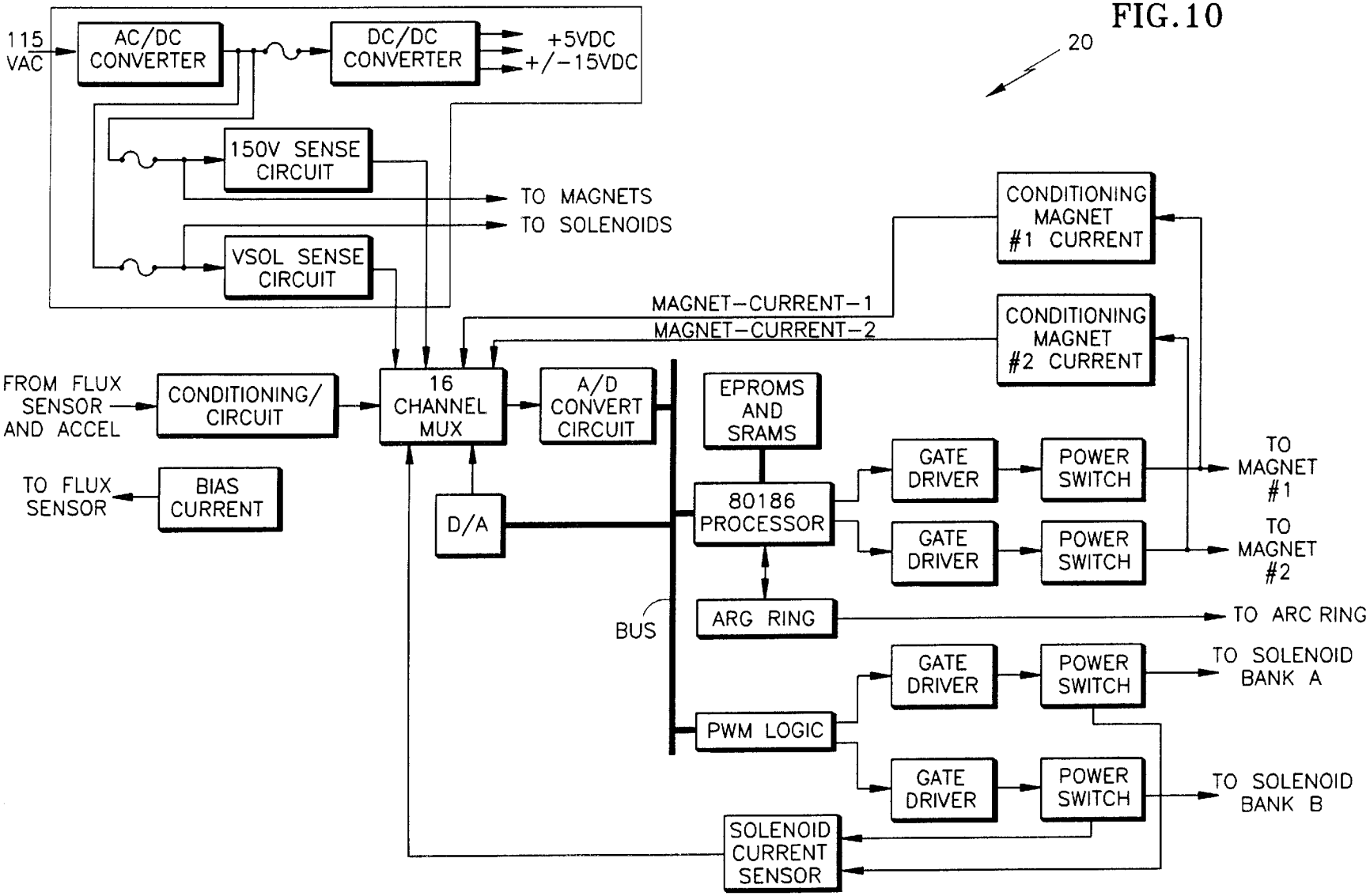
FIG. 10 shows a block diagram of an active roller guide control board for providing centering and vibration control for the elevator car 12 in FIG. 1.

FIG. 10 shows in detail the elevator car controller 20 (FIG. 1) as an ARG control board hardware block diagram that provides centering and vibration control with respect to at least one axis of the elevator car 12. Typically, an elevator car is controlled with respect to one or more axes, including side-to-side and/or front-to-back control. Elevator car controllers for controlling an elevator car about one or more axes are known in the art, and may include controllers shown and described in the aforementioned United States patents, as well as U.S. Pat. Nos. 5,308,938; 5,329,077; 5,367,132; 5,373,123; 5,400,872; as well as United States patent applications presently pending in the Patent Office, including Ser. Nos. 08/292,660, filed Aug. 18, 1994, and 08/688,918, filed Jul. 31, 1996, all hereby also incorporated by reference. Moreover, ARG control boards for respective axes may be coupled together to share information via an ARG axis interface control circuit. The scope of the invention is not intended to be limited to any particular axis, or any particular number of axes of the elevator car control.

Figure 11:
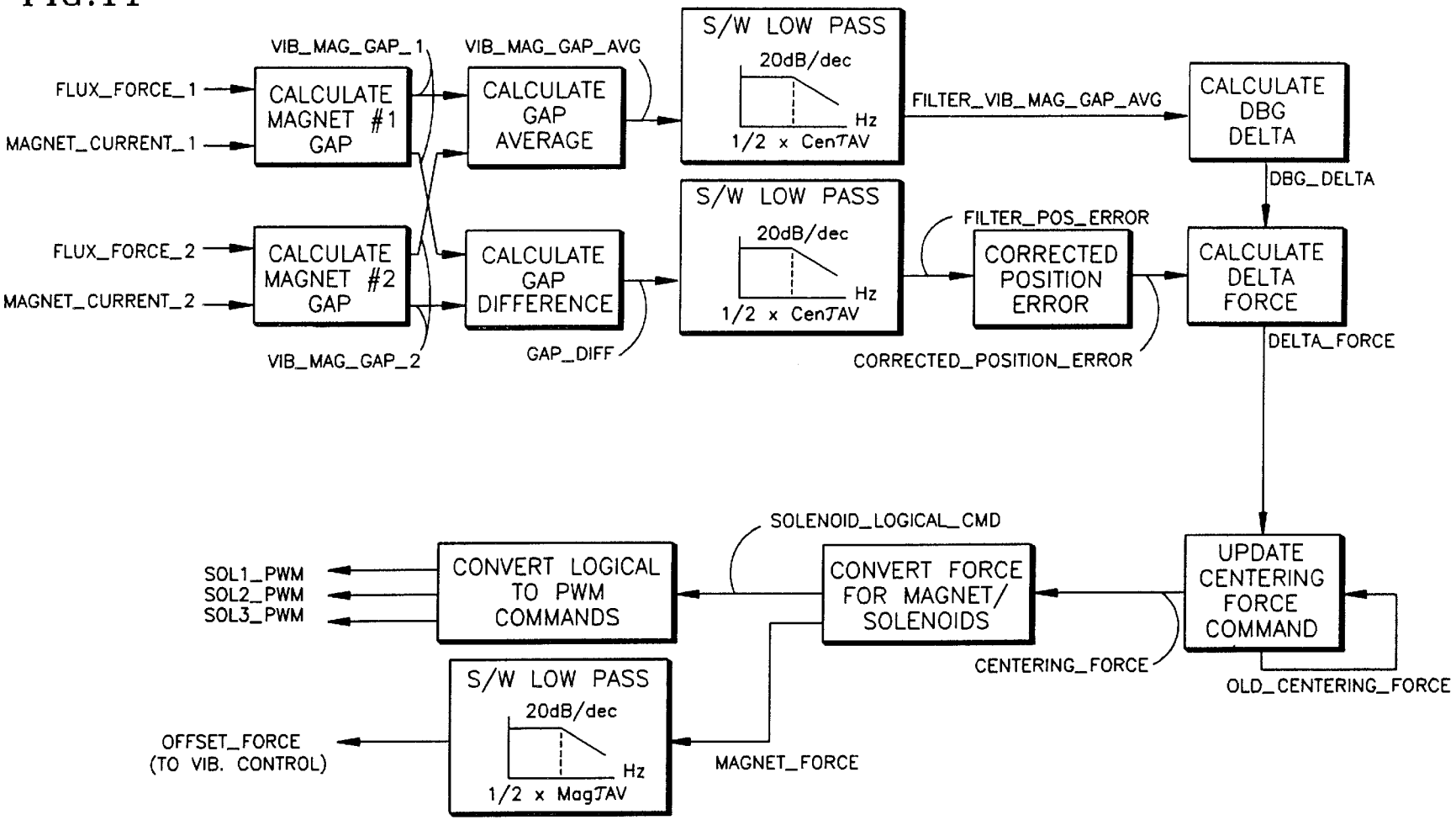
FIG. 11 is a block diagram of a software algorithm for providing centering control of the elevator 12 in FIG. 1.
Figure 12A:
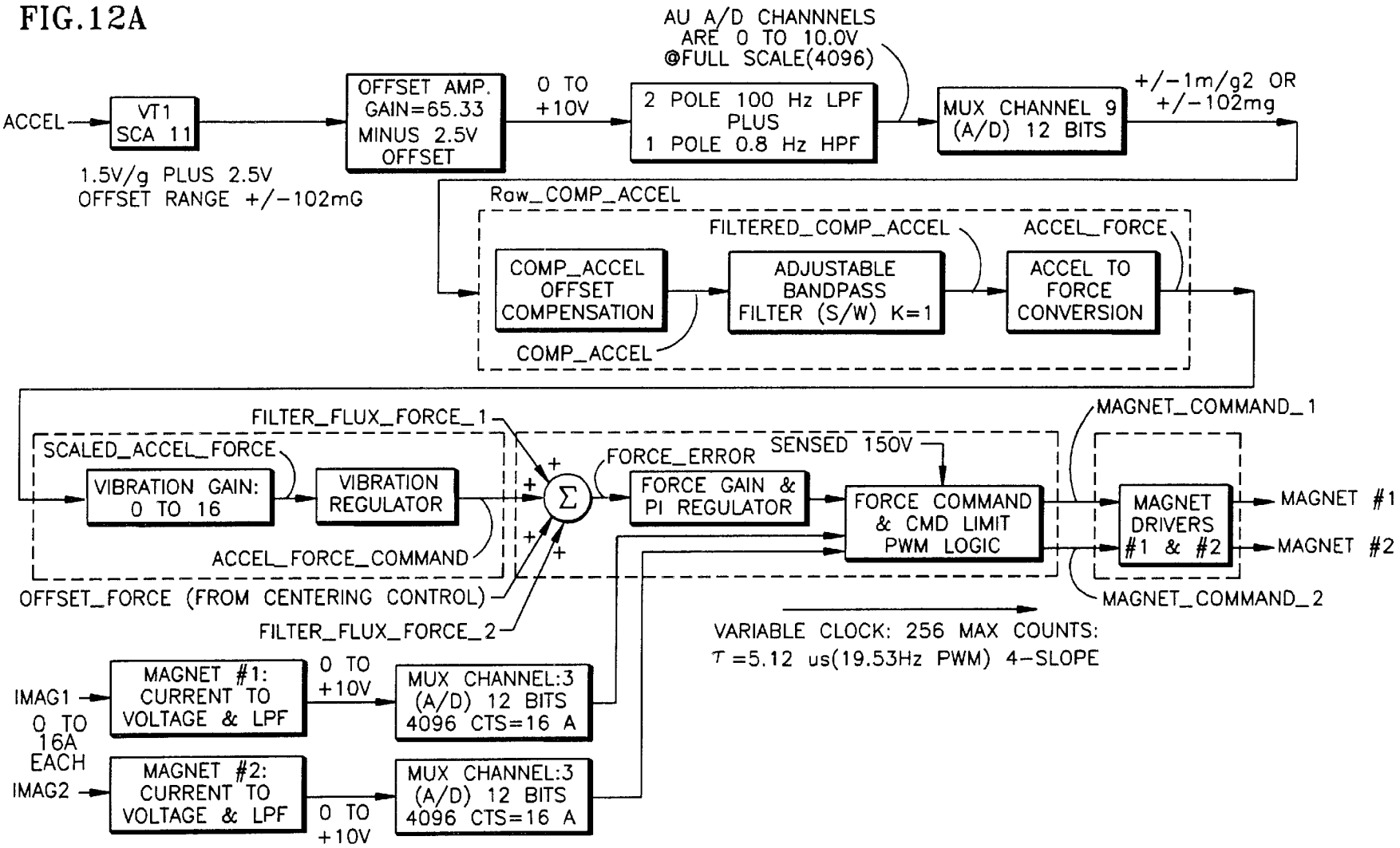
FIG. 12(A) shows a vibration control overview which may be used in an elevator car controller 20 in FIGS. 1–2.
Figure 12B:
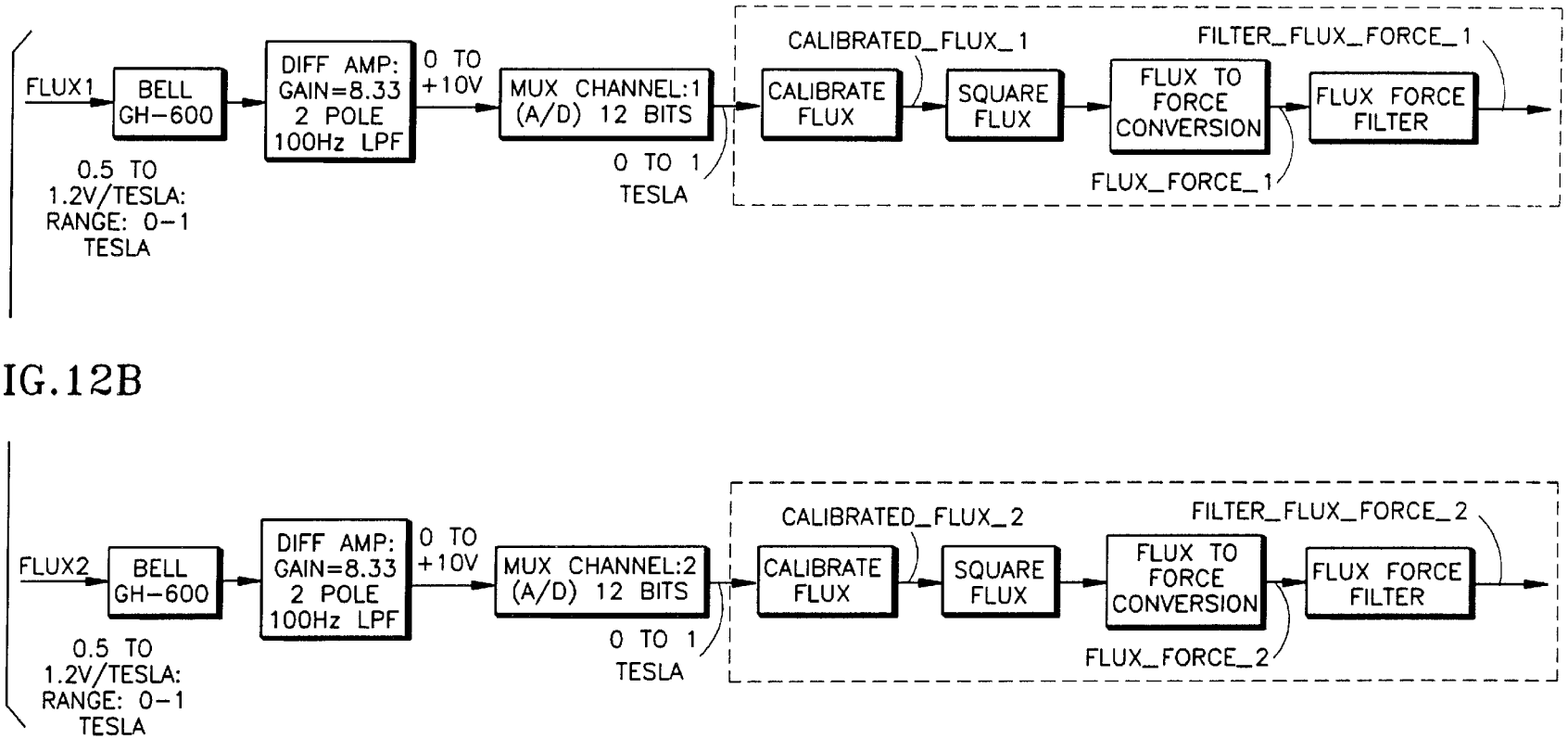
FIG. 12(B) shows a flux sensing overview which may be used to provide filter_flux force signals 1 and 2 in FIG. 10.

In FIG. 10, the ARG control board hardware block diagram is a microprocessor-based system having a 80186 processor that provides software control. FIG. 11 is a block diagram of a software algorithm for providing centering control of the elevator 12 in FIG. 1. FIG. 12(A) shows a vibration control overview which may be used in an elevator car controller 20 in FIGS. 1–2, and FIG. 12(B) shows a flux sensing overview which may be used to provide filter_flux force signals 1 and 2 in FIG. 12(A). In FIGS. 12(A) and 12(B), the software blocks are generally indicated by dotted lines. The 80186 processor in FIG. 10 performs the software algorithm in FIGS. 11, 12(A) and 12(B). Any person skilled in the art would appreciate that many of the blocks shown in FIGS. 10, 11, 12(A) and 12(B) may be implemented as either hardware or software. The scope of the invention is not intended to be limited to any particular manner in which an elevator control function is implemented, i.e. by either hardware or software. FIGS. 10, 11, 12(A) and 12(B) are described below in conjunction with one another.

As shown in FIG. 11, a CALCULATE MAGNET #1 GAP block responds to a Flux_Force_1 signal (see FIG. 12(B) and a Magnet_Current_1 signal (see FIG. 10), for providing a Vib_Mag_Gap_1 signal. Similarly, a CALCULATE MAGNET #2 GAP block responds to a Flux_Force_2 signal and a Magnet_Current_2 signal, for providing a Vib_Mag_Gap_2 signal. A CALCULATE GAP AVERAGE block responds to the Vib_Mag_Gap_1 signal and the Vib_Mag_Gap_2 signal, for providing a Vib_Mag_Gap_Avg signal. A CALCULATE GAP DIFFERENCE block responds to the Vib_Mag_Gap_1 signal and the Vib_Mag_Gap_2 signal, for providing a Gap_Diff signal. The CONDITIONING CIRCUIT and CONDITIONING MAGNET #1, #2 blocks in FIG. 10 provide front end signal conditioning for the CALCULATE MAGNET #1 GAP block, the CALCULATE MAGNET #2 GAP block, the CALCULATE GAP AVERAGE block and the CALCULATE GAP DIFFERENCE block in FIG. 11.

The Vib_Mag_Gap_Avg signal and the Gap_Dif signal are processed by the 80186 processor in FIG. 10. As shown in FIG. 11, a software (S/W) Low Pass block transforms the Vib_Mag_Gap_Avg signal into a Filter_Vib_Mag_Gap_Avg signal, and a second S/W Low Pass block transforms the Gap_Diff signal into a Filter_Pos_Error signal. A CALCULATE DBG DELTA software block transforms the Filter_Vib_Mag_Gap_Avg signal into a DBG_Delta signal. (Note that the acronym "DBG" means "Distance Between Guides".) A CORRECTED POSITION ERROR software block transforms the Filter_Pos_Error signal into a Corrected_Position_Error signal. A CALCULATE DELTA FORCE software block transforms the DBG_Delta signal and the Corrected_Position_Error signal into a Delta_Force signal. An UPDATE CENTERING FORCE COMMAND software block transforms the Delta_Force signal and an Old_Centering_Force signal into a Centering_Force signal. A CONVERT FORCE for Magnet/Solenoid software block transforms the Centering_Force signal into a Solenoid_Logical CMD signal and a Magnet-Force signal. The Solenoid_Logical CMD signal is communicated via the BUS in FIG. 10 to the solenoid PWM hardware. (Note that "CMD" means "command".) The Solenoid_Logic CMD signal contains information about whether one or more solenoids will be activated or deactivated for centering control to adjust the position of the elevator car in relation to the guide rails, and the Magnet-Force signal contains information about whether the one or more electromagnets will be activated or deactivated for centering the car between each roller and a respective guide rail. A CONVERT LOGICAL TO PWM COMMANDS block in FIG. 11 corresponds to the PWM Logic block in FIG. 10. The CONVERT LOGICAL TO PWM COMMANDS block in FIG. 11 responds to the Solenoid_Logical CMD signal, for providing a SOL_1_PWM signal, a SOL_2_PWM signal, and a SOL_3_PWM signal, which are further processed by the GATE DRIVER and POWER SWITCH blocks in FIG. 10 for providing a solenoid control signal to solenoid banks A and B. A S/W Low Pass filter block transforms the Magnet-Force signal into an Offset_Force signal that is provided to a software summing junction shown and described with respect to FIG. 12(A).

The Microfiche Appendix includes a computer program listing of a centering control module to perform the software algorithm in FIG. 11. The program listing in the Microfiche Appendix is an algorithm for apportioning solenoid and magnet force for centering control. In general, in the computer program listing, a total centering force is computed as a function of a delta force, and a centering force is clamped at a maximum centering force if necessary. A check is made to determine whether or not a maximum number of solenoids should be turned on. A variable PerSolenoidForce/2 is determined which represents a range where only the electromagnets are used for centering control. For example, if the PerSolenoidForce equals 184 Newtons, then the PerSolenoidForce/2 equals 92 N. If the centering force plus the PerSolenoidForce/2 is greater than or equal to the maximum centering force, then the number of solenoids turned on equals the number of solenoids. Otherwise, the number of solenoids turned on is calculated directly from the total centering force required together with the solenoid force per solenoid using the equation:

$$\#\text{OfSolenoidsOn} = \frac{(\text{CenteringForce} + (\text{PerSolenoidForce}/2)}{(\text{PerSolenoidForce})}.$$

Next, the amount of force associated with the number of solenoids turned on is calculated using the equation:

SolenoidForce=#OfSolenoidsOn*PerSolenoidForce;

Finally, a magnet force required to take up the balance of the total centering force is calculated using the relationship:

MagnetForce=CenteringForce−SolenoidForce;

The above equations are valid for the case where the centering force required is positive. For the case where centering force is negative, the equations are the same, except that the sign of the variables CenteringForce and SolenoidForce is negated. These equations are consistent with that shown and described with respect to the centering force diagram shown in FIG. 13, discussed below.

FIG. 12(A) shows a vibration control overview which may be used in the elevator car controller 20 in FIGS. 1–2. In such an embodiment, a hybrid approach is used in which the electromagnet formerly used for vibration control only also supplies some of the centering force required, i.e. fine position control. For example, in the side-to-side operation, each solenoid 138 (see FIG. 6) only coarsely provides the same single force. The fine resolution of total centering force is provided by the electromagnets 150 (see also 34, 36 in FIG. 1) on each side of the elevator car. This fine resolution force is commanded by an "Offset Force" command signal from the S/W Low Pass block of FIG. 11 and shown entering a software summing junction (Σ) described below as the "Offset Force" (From Centering Control) in FIG. 12(A), and used in conjunction with the solenoid force for centering the car.

In particular, FIGS. 12(A) and (B) show an overview of a side-to-side or a front-to-back hybrid vibration/fine-centering control system for the elevator car. In general, the vibration/fine-centering control system is a feedback control loop in which an acceleration of the elevator car 12 (FIG. 1) and both a flux and current of the electromagnet 150 (FIG. 6) are sensed and used to determine the airgap and a counteracting force to negate the acceleration on the elevator car 12 and, in conjunction with the coarse solenoid actuators, to keep the car finely centered in the hoistway using fine position resolution control. As shown, the vibration control system is implemented in both hardware and software, with the solid boxes being representative of a hardware implementation and dotted boxes being representative of a software implementation. The software blocks are performed by the 80186 processor shown in FIG. 10. The scope of the invention is not intended to be limited in any way to whether a particular function is implemented in hardware or software.

Any person skilled in the elevator active suspension control art would appreciate after reviewing the vibration control system shown in FIG. 12(A) how an elevator car acceleration is sensed and converted into the counteracting force to negate the acceleration on the elevator car 12. In view of this, only a brief description of the vibration control system shown in FIG. 12(A) is provided herein. The vibration control system includes a VT1/SCA 11 block that represents a sensor for sensing an actual acceleration of the elevator car, for providing a signal representing an actual elevator car acceleration. An OFFSET AMP block is a signal processing block that shifts the actual elevator car acceleration signal, amplifies it to usable voltage level, and provides an amplified signal corresponding to the actual elevator car acceleration. In effect, the shift is to a full scale range because the output of the accelerometer is in microvolts, so the second block is a signal processing block to provide a desirable voltage range. A LOW PASS FILTER block filters out noise and irrelevant signals beyond 100 Hertz, for providing a filtered analog signal. The CONDITIONING CIRCUIT block in FIG. 10 includes the VT1/SCA 11 block, the OFFSET AMP block and the LOW PASS FILTER block in FIG. 12(A).

A MUX CHANNEL (A/D) block multiplexes and performs an analog to digital conversion, and provides a digital filtered acceleration signal corresponding to the actual elevator car acceleration to a microprocessor for processing the signal, as shown by the dotted blocks. The 16 CHANNEL MUX in FIG. 10 includes the MUX CHANNEL (A/D) block in FIG. 12(A).

The 80186 processor in FIG. 10 executes a COMP_ACCEL OFFSET COMPENSATION software block for providing a Comp_Accel signal to an ADJUSTABLE BAND PASS FILTER block, which processes the digital filtered acceleration signal, and provides a Filtered_Comp_Accel signal to an ACCEL TO FORCE CONVERSION software block for performing the acceleration to force conversion and providing an Accel_Force signal. A VIBRATION GAIN software block processes the Accel_Force signal to adjust the gain in the control loop, and provides a Scaled_Accel_Force signal to a VIBRATION REGULATOR software block. The VIBRATION REGULATOR software block processes the Scaled_Accel_Force signal and provides an Accel_Force_Command signal to a software summing junction in another software block. In effect, the Accel_Force_Command signal is a signal representing a force that was converted from an accelerometer input signal, and is commonly known as a force dictation signal, i.e. it represents the amount of force needed to counteract the sensed acceleration.

The SUMMING JUNCTION software processes four signals, the Accel_Force_Command signal, a Filter_Flux_Force_1 signal from a filtered_flux_force_1 circuit shown and described with respect to FIG. 12(B), a Filter_Flux_Force_2 signal from a filtered_flux_force_2 circuit also shown and described with respect to FIG. 12(B), and the OFFSET_FORCE signal from an elevator car centering side-to-side control, discussed above. The SUMMING JUNCTION software responds to these four signals and provides a Force_Error signal to a FORCE GAIN & PI REGULATOR block. The FORCE GAIN & PI REGULATOR software block processes the Force_Error signal, and provides a force gain and proportional/integral regulator signal to a FORCE COMMAND AND CMD LIMIT LOGIC PWM LOGIC block.

The magnet current feedback loop of the vibration control also includes the following: A MAGNET #1: CURRENT/VOLTAGE & LPF block that responds to an IMAG1 current from electromagnet #1 and provides a current/voltage converted and low pass filtered signal. A MUX CHANNEL:3 (A/D) block multiplexes and A-to-D converts the current/ voltage converted and low pass filtered signal and provides a digital filtered IMAG1 signal to the microprocessor for processing. The digital filtered IMAG1 signal represents a feedback current of the current being provided to electromagnet #1. Similarly, a MAGNET #2: CURRENT/VOLTAGE & LPF block responds to an IMAG2 current from electromagnet #2 and provides a current/voltage converted and low pass filtered signal. A MUX CHANNEL (A/D) block multiplexes and A-to-D converts the current/voltage converted and low pass filtered signal and provides a digital filtered IMAG2 signal to the microprocessor for processing. Similarly, the digital filtered IMAG2 signal represents a feedback current of the current being provided to electromagnet #2. The conditioning MAGNET #1 AND #2 BLOCKS FIG. 10 correspond to the MAGNET #1: CURRENT/VOLTAGE & LPF and MAGNET #2: CURRENT/VOLTAGE & LPF blocks, and the 16 CHANNEL MUX in FIG. 10 includes the MUX CHANNEL:3 and the MUX CHANNEL:4 (A/D) blocks.

The FORCE COMMAND & CMD LIMIT PWM LOGIC software block responds to the Force Gain & Proportional/Integral Regulator signal, the digital filtered IMAG1 signal, the digital filtered IMAG2 signal and the sensed 150 voltage signal from the 150V Sense Circuit of FIG. 10, for providing a Magnet_command_1 signal and a Magnet_command_2 signal. A MAGNET DRIVER #1 AND #2 software block responds to the Magnet_command_1 signal and the Magnet_command_2 signal, for providing a PWM magnet driver signal for an electromagnet #1 and a PWM magnet driver signal for an electromagnet #2 to generate the counteracting force to negate the acceleration on the elevator car 12 and for fine centering. The electromagnet #1 may be an electromagnet such as the electromagnet 34 of FIG. 1 and the electromagnet #2 may be an electromagnet such as the electromagnet 36, as also shown in FIG. 1. The electromagnets may also be electromagnets on each side of a rail for front-to-back guide. The magnet driver signals for electromagnets #1 and #2 are further processed by GATE DRIVER blocks and POWER SWITCH blocks associated with electromagnets #1 and #2 in FIG. 10, for providing gate driver and power switch signals to electromagnets #1, #2 for providing fine centering and vibration control of the elevator car 12.

FIG. 12(B) represents circuits for force feedback for electromagnet #1 and electromagnet #2, such as electromagnets 34, 36, or vice versa in FIG. 1. The circuit for electromagnet #1 responds to actual sensed flux from electromagnet #1 and provides a Filter_Flux_Force_1 signal to the summing junction software of FIG. 12(A). Similarly, the circuit for electromagnet #2 responds to actual sensed flux from electromagnet #2 and provides a Filter_Flux_Force_2 signal to the summing junction software. In both circuits, the circuit BELL GH-600 represents a flux sensor such as 180 shown in FIG. 6, which converts flux to voltage, and provides a sensed flux signal. The sensed flux signal is processed in a signal processing stage, a gain stage and a roll-off and a filtering stage for providing a voltage signal in a useful range like 0–10 volts. The voltage signal is then multiplexed and converted to a digital 12-bit signal, then provided to the microprocessor for software processing, where it is calibrated, squared, converted from a flux signal to a force signal, filtered, and provided as the Filtered_Flux_Force signal_l, discussed above. The CONDITIONING CIRCUIT block in FIG. 10 includes the BELL GH-600 and DIFF AMP: GAIN blocks in FIG. 12(B). The 16 CHANNEL MUX in FIG. 10 includes the MUX CHANNEL (A/D) blocks in FIG. 12(B). The circuit for electromagnet #2 operates in a similar manner.

This approach of using a plurality of identically sized solenoids for coarse position control in conjunction with fine position control using electromagnets has a number of benefits over alternative embodiments using a plurality of coarse and finely graded solenoids, discussed below in connection with FIGS. 14–18, for the following reasons:

fewer solenoids less maximum solenoid force required all solenoids, springs and spring seats identical better force resolution softer effective spring constants possible at the roller (i.e. more practical implementation, especially side-to-side)

more graceful degradation in the event of a bad solenoid.

As shown, the control system has an acceleration loop and a force loop.

Figure 13:
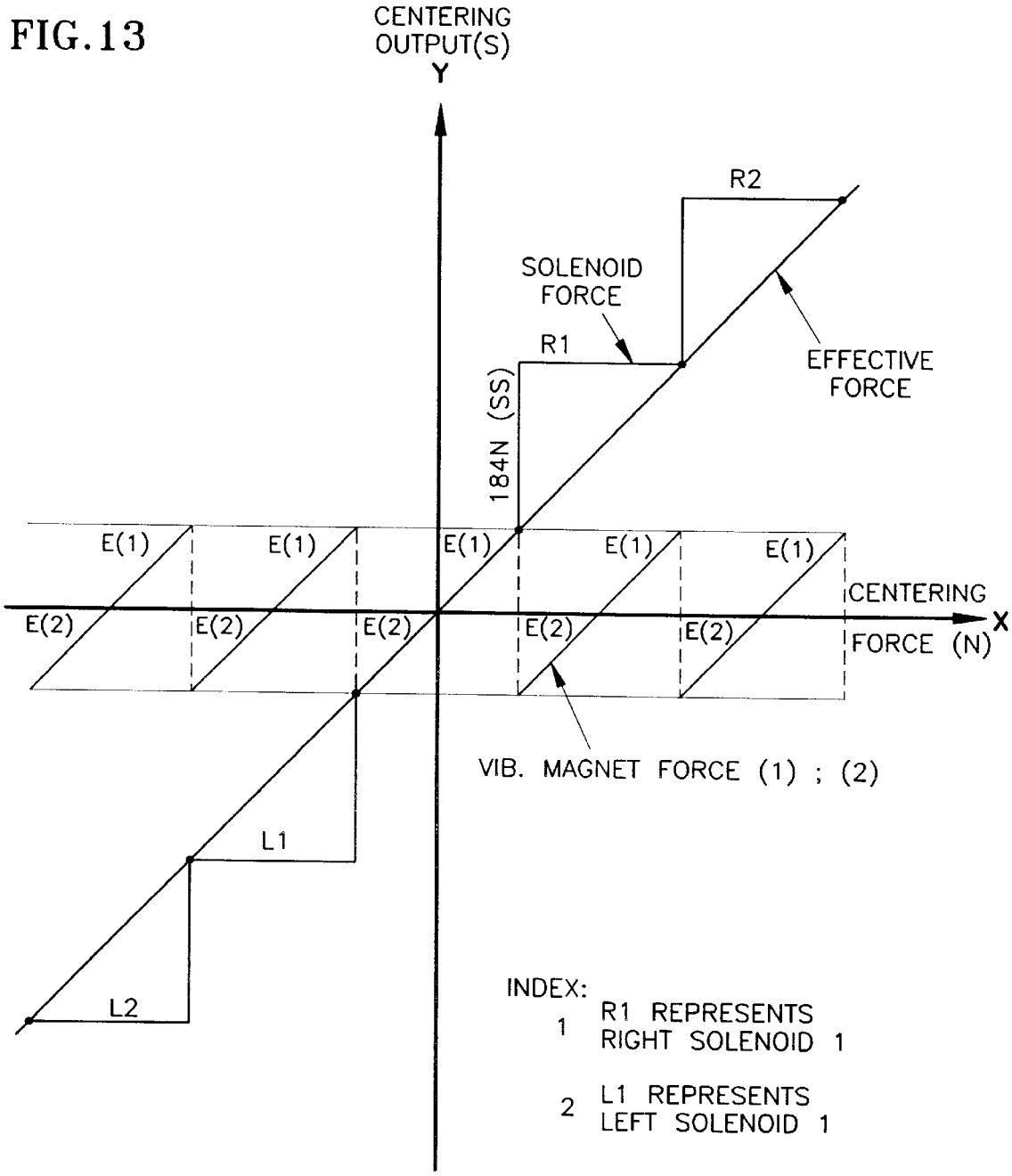
FIG. 13 is a graph depicting centering output force(s) versus a required centering force.

FIG. 13 is a graph depicting centering output force(s) on the ordinate versus centering force required on the abscissa and is presented in this way in order to show how a composite of coarse solenoid and fine electromagnet forces result in a smooth "effective force". In general, the solid diagonal line represents the sum of the coarse (step) solenoid and the fine (ramp) electromagnet forces. The staircase curve superimposed on the solid diagonal line represents step changes in solenoid force (184 Newtons) each time a solenoid is separately activated (or deactivated). The series of diagonal lines (sawtooth) superimposed on the abscissa represents the force output of the electromagnets shifted as a function of the level of centering force required of the solenoids by the control of FIG. 11. The notations (1) and (2) indicate which electromagnet is activated, i.e., depending on whether the effective force exerted is positive or negative, respectively. Electromagnet (2) is used to apply force which is referred to as a "negative" force for the purpose of establishing a convention.

In particular, the graph in FIG. 13 shows a side-to-side centering control for an elevator system using both the solenoids and the electromagnets such as those shown and described above. FIG. 13 has a total centering output in the ordinate or vertical axis as a function of a required centering force on the horizontal X axis. The top right or first quadrant of the graph represents the actuation of one or more right side solenoids, and the lower left quadrant of the graph represents the actuation of one or more left side solenoids. (In a front-to-back centering control, the top right quadrant of the graph may represent the actuation of one or more back side solenoids, and the lower left quadrant of the graph represents the actuation of one or more front side solenoids.) The force of the left and right electromagnets is represented as a sawtooth function of lines labelled "1" and "2" respectively in the center and along the X axis or abscissa of the graph. The diagonal line from the lower left or third quadrant to the top right or first quadrant in FIG. 13 represents an effective force, which is determined by summing together the solenoid force and the force from the electromagnets. The solenoid force has a step function characteristic having steps of 184 Newtons. An arrow labeled "solenoid force" points to a solenoid step change in solenoid force. As shown, an arrow labeled "vibration electromagnets (1); (2)" points to the sawtooth function in the middle of the graph representing the forces of the electromagnets within a similar range of −92 Newtons<0<+92 Newtons on the ordinate.

The cooperation between the solenoids and the magnets will be briefly described. In the vicinity of the origin, the electromagnets (1) and (2) work in a range of −92 Newtons to +92 Newtons, and no solenoids are turned on the left side or the right side of the elevator car. As one example, the electromagnet E(1) may be supplying the centering force in a range of 0 to +92 Newtons and therefore be operating in the initial ramp portion of the effective force line in quadrant 1, before any solenoid is actuated. At 92 Newtons there is a dotted line showing one solenoid activated on the right side of the elevator car to provide a 184 Newtons change in centering force. At the same time, electromagnet (1) is deactuated at 92 Newtons and electromagnet (2) is activated on the left side of the elevator car at 92 Newtons, so there is no effective change in force with respect to the elevator car. If more or less centering force is needed, then electromagnet (2) may be respectively decreased or increased within a range of 0–92 Newtons, i.e., back to the origin, or further along the effective force line into quadrant 1. Eventually when the force exceeds the range of 0–92 Newtons, then the solenoid E(1) has to be turned on or off or E(1) is reactivated and the appropriate electromagnets (1) or (2) will be actuated. As will be evident to any person of skill in the art, the same process can be continued in either direction in stepwise fashion and by actuating and deactuating the appropriate actuators.

Parallel Binomial Solenoids

Figure 14:
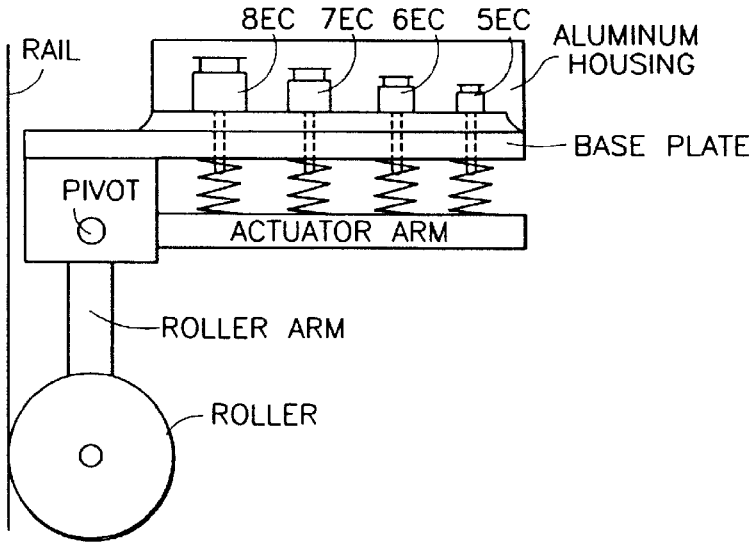
FIG. 14 shows an embodiment of the present invention having parallel solenoid digital linear magnetic actuators (DLMA).

FIG. 14 shows an embodiment of the present invention having solenoids with different sizes arranged in a parallel connection. The individual solenoids are all connected to a main supporting plate, which provides good heat transfer characteristics for the assembly. Each solenoid pushes on the reacting arm through its own linear spring. The embodiment is similar to the embodiment shown and described with respect to FIGS. 3–13 above in that the parallel solenoids are arranged in a line.

The selection of solenoid size, working stroke, and individual spring constant provides the ability to command $2^{(n-1)}$ different force levels through the actuator, as a function of an "n" bit command, where each command bit corresponds to one of the solenoids. The "weighting" of each solenoid/spring unit can be made to be binary. For example, in the case of four bits, the largest solenoid commands 8/15 of the total force, the next largest solenoid commands 4/15 of the total force, etc.

In the case of the Active Roller Guide, the solenoids and Digital Linear Magnetic Actuators are commanded by a controller which calculates the gap width in the vibration control magnets by sensing the flux in the vibration magnet gap, and comparing this with the current in the vibration magnet winding (vibration magnets not shown in FIG. 14). These gaps are sampled many times a second, and the average gap is calculated by the controller for the purpose of determining whether or not the car is centered relative to the rails.

When power is applied to a solenoid, it extends by the amount of its working stroke. In general, the product of the solenoid stroke and its associated spring constant must represent a doubling of force with each additional solenoid in the assembly, in order to maintain a binary weighting. The resolution of the solenoid configuration is defined by the smallest solenoid/spring combination, and the dynamic range of the solenoid configuration is defined by the number of solenoids, in conjunction with the resolution.

In equation form, the solenoid configuration force $F_{so1}$ generated by the parallel DLMA can be represented by the following:

$$F_{sol} = \sum_{a=1}^{a=n} Ca*Xa*Ka$$

where n is the number of solenoids, Ca is the binary command to solenoid n, Xa is the stroke of solenoid n, and Ka is the spring constant of the spring associated with a.

This series of actuator strokes as represented by a binary number, (0 to 16 in FIG. 14) makes the command of the actuator very simple to implement with standard digital design approaches.

The worst case force transmitted through the largest solenoid is only 8/15 of the total. This represents a considerable relaxation of force requirements on individual solenoids in the actuator, as compared with the series stack of solenoids, discussed below.

In an ordinary magnetic actuator, supplying static holding forces across the normal working gap of the magnet (assuming that the spring constant is the same as the effective spring constant at the roller guide) would lead to very large magnet designs, (at 1:1 mechanical advantage) which would be expensive in terms of weight and power consumption. In the case of the Digital Linear Magnetic Actuator, however, each solenoid is operated at minimum gap, resulting in lower power consumption and smaller size.

Figure 15:
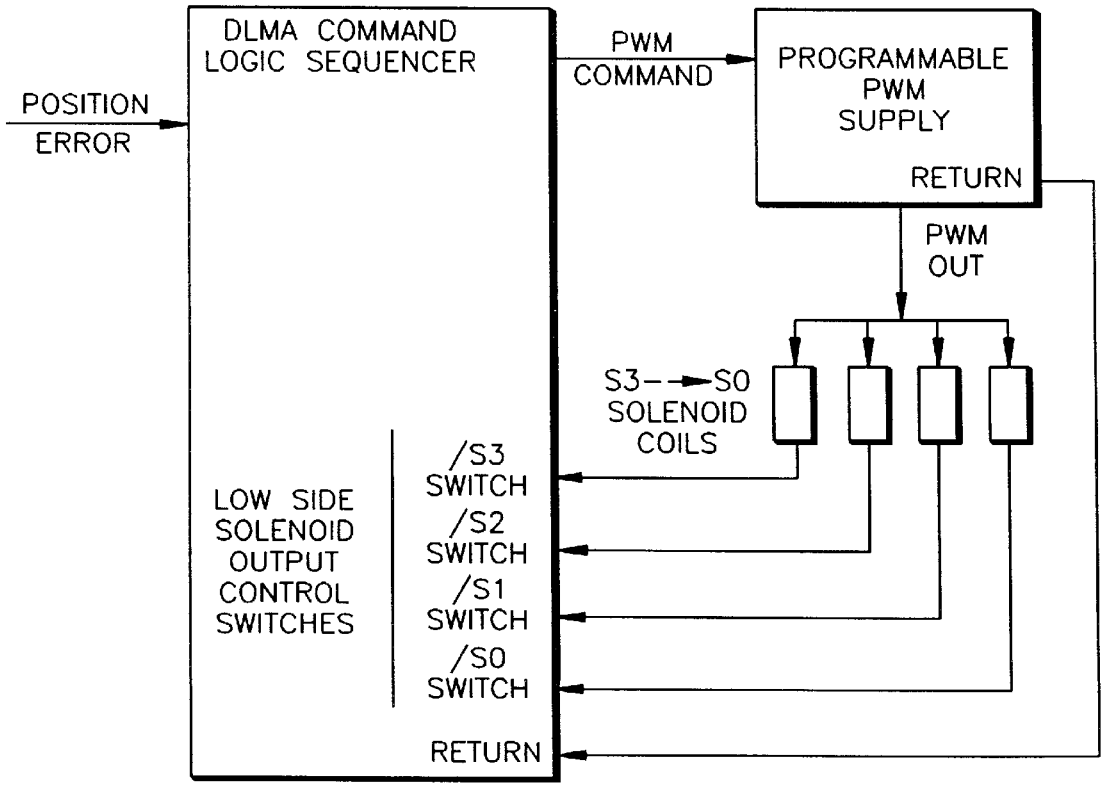
FIG. 15 shows a parallel DLMA control technique for the embodiment shown in FIG. 14.

FIG. 15 illustrates a command and control technique for the embodiment shown in FIG. 14 that may be implemented by an elevator car controller such as 20 shown in FIGS. 1–2. The supply voltage for the solenoids is a Pulse Width Modulated rectangular waveform. When any given combination of solenoids is fully engaged, the reluctance of each activated solenoid is at maximum, and the DC current demand for a given PWM duty cycle is at minimum. If the stroke of the actuator needs to be changed, then the PWM duty cycle is reset, and the new digital command is selected. The appropriate actuators engage and disengage, and then in the next update cycle, the PWM duty cycle is set to a new value based upon the following:

PWM Duty Cycle=A*####, where A is a constant which is a function of solenoid vendor holding voltage, and where #### is the binary stroke commanded to the actuator, corresponding to static holding force.

Figure 16:
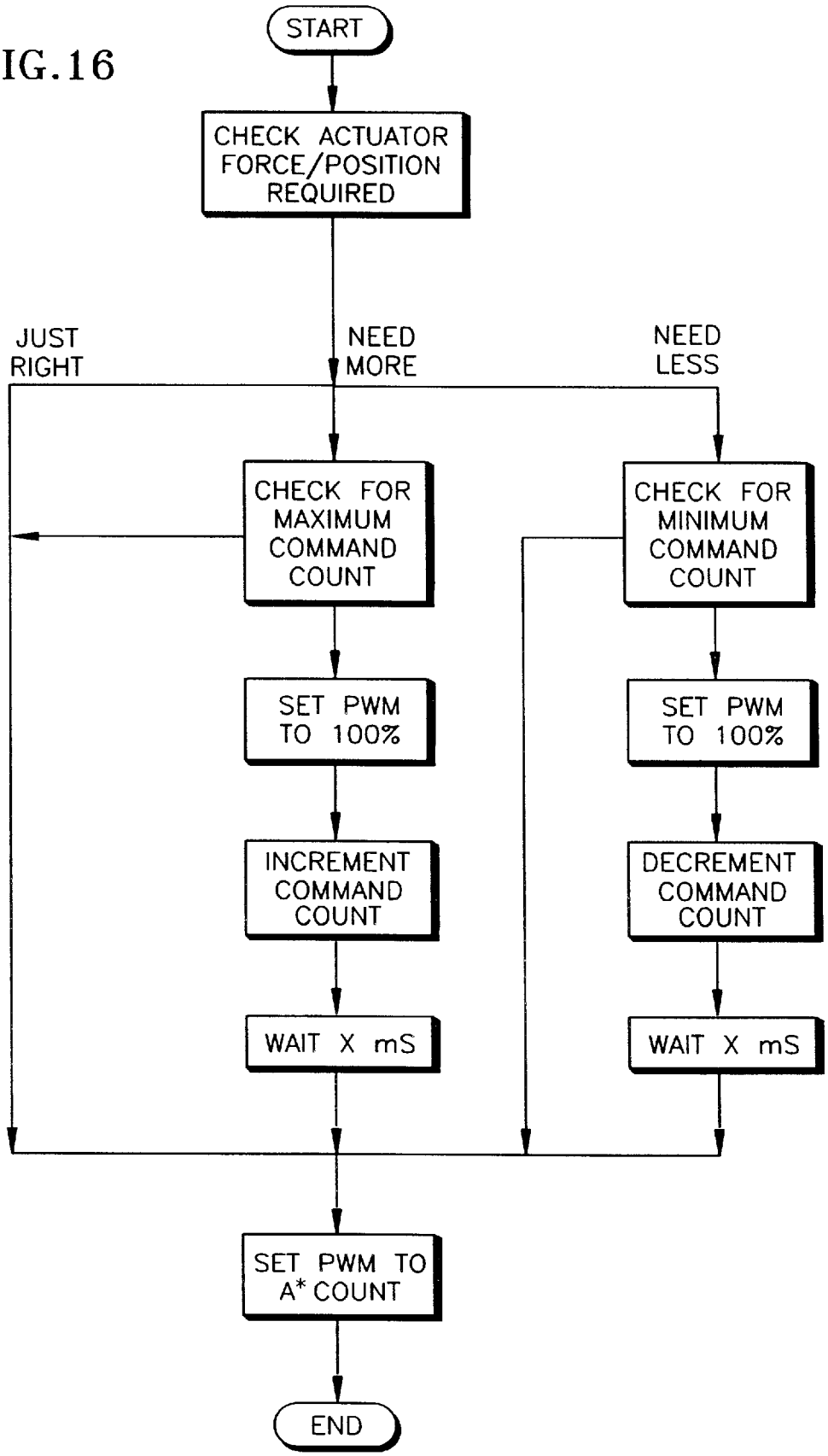
FIG. 16 shows a flowchart for a solenoid logical command determination for the embodiment shown in FIG. 14.

FIG. 16 provides an illustration of the PWM control sequence for the embodiment shown in FIG. 14 with each actuator command update. First, the position reference is checked to determine if more or less centering force is required. If more is required, then the current actuator command is checked to determine if the command is at maximum (1111). If so, then no more force can be applied. If the command is not at maximum, then the PWM command is set to 100%, and the actuator command count is incremented by one.

In the case of less centering force being required, the command count is checked to confirm that it is greater than minimum (0000). If so, then the PWM command is set to 100% and the actuator command is decremented by one. If the command is already 0000, then no less force can be applied on this roller; centering force must be applied against the opposite roller.

After making the adjustment to the actuator command count, after a delay period, the Pulse Width Modulated command is set to A times the actuator command count, for the purpose of minimum power dissipation.

When the Digital Linear Magnetic Actuator is commanded in this manner, the net change is 1/15 of maximum per update. For the Active Roller Guide application, this granularity of centering control is adequate. The step change in the force through the spring can easily be compensated for by the vibration control magnets, in conjunction with acceleration feedback from the elevator car frame.

In summary, the parallel Digital Linear Magnetic Actuator provides the benefits of a magnetic actuation device which is reliable, while circumventing the power consumption problem, by operating individual devices at minimum gap. Minimum power is required for keeping the magnets from "ungluing" during dynamic events by commanding the Pulse Width Modulated supply as a function of the total static force transmitted through the actuator, plus margin. The heat transfer characteristics are favorable, and alignment problems are avoided. The maximum force requirements on individual solenoids are reduced.

The implementation described here uses linear springs; the concept is equally applicable when applied to spiral springs and rotary solenoids, although this approach would require multiple mounting plates.

Series Binomial Stack of Solenoids

Figure 17:
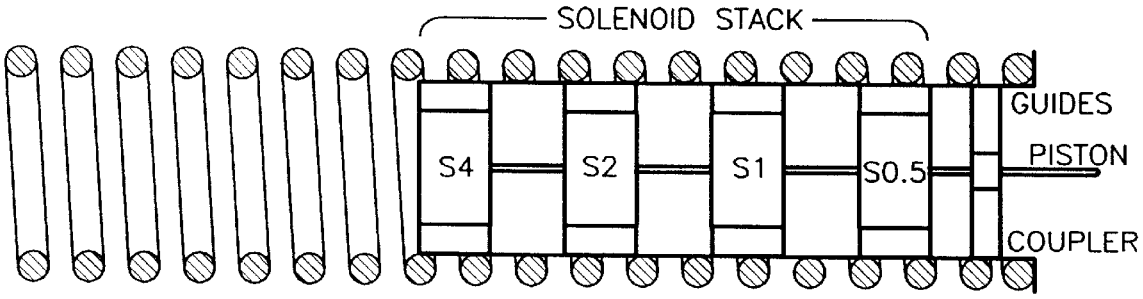
FIG. 17 shows an embodiment of the present invention having a stacked series of solenoid digital linear magnetic actuators.

FIG. 17 shows a cut-away view of an implementation of a Digital Linear Magnetic Actuator assembly, having DLMAs in series with the suspension spring. The DLMAs are commanded by a controller which senses the gap width in the vibration control magnets by sensing the flux in the vibration magnet gap, and comparing this with the current in the vibration magnet winding. These gaps are sampled many times a second, and the average gap is calculated by the controller for the purpose of determining whether or not the car is centered relative to the rails. The position sampling technique is the same as the one described above.

As shown, the implementation is comprised of a linear coil spring with a spring constant $K_s$. A cup is mounted inside the coil spring which serves as a receptacle for multiple solenoids. In the example shown, four are used. The solenoids are stacked "in series" inside the receptacle, and each solenoid has a different stroke as summarized below:

Examples of DLMA solenoid strokes are:

S4.0: 4.0 mm

S2.0: 2.0 mm

S1.0: 1.0 mm

S0.5: 0.5 mm

When power is applied to a solenoid, it extends by the amount associated with its label, i.e. 4, 2, 1, or 0.5 mm. This series is a specific example; in general, to maintain binary weighting, the series of solenoid strokes must represent a doubling of strokes with each additional solenoid. The resolution of the solenoid stack is defined by the smallest stroke solenoid, and the dynamic range of the solenoid stack is defined by the number of solenoids, in conjunction with the resolution.

Thus, for this example, the actuator provides a 0 to 7.5 mm stroke, with 0.5 mm resolution, as summarized by the table below:

| S4 | S2 | S1 | S0.5 | Stroke | Force |
|---|---|---|---|---|---|
| 0 | 0 | 0 | 0 | 0 | 0 |
| 0 | 0 | 0 | 1 | 0.5 | Ks*Stroke |
| 0 | 0 | 1 | 0 | 1.0 | Ks*Stroke |
| 0 | 0 | 1 | 1 | 1.5 | Ks*Stroke |
| 0 | 1 | 0 | 0 | 2.0 | Ks*Stroke |
| 0 | 1 | 0 | 1 | 2.5 | Ks*Stroke |

-continued

| S4 | S2 | S1 | S0.5 | Stroke | Force |
|---|---|---|---|---|---|
| 0 | 1 | 1 | 0 | 3.0 | Ks*Stroke |
| 0 | 1 | 1 | 1 | 3.5 | Ks*Stroke |
| 1 | 0 | 0 | 0 | 4.0 | Ks*Stroke |
| 1 | 0 | 0 | 1 | 4.5 | Ks*Stroke |
| 1 | 0 | 1 | 0 | 5.0 | Ks*Stroke |
| 1 | 0 | 1 | 1 | 5.5 | Ks*Stroke |
| 1 | 1 | 0 | 0 | 6.0 | Ks*Stroke |
| 1 | 1 | 0 | 1 | 6.5 | Ks*Stroke |
| 1 | 1 | 1 | 0 | 7.0 | Ks*Stroke |
| 1 | 1 | 1 | 1 | 7.5 | ks*Stroke |

This series of actuator strokes can be represented by a 4 bit binary number, 0 to 16, and makes the command of the actuator very simple to implement with standard digital design approaches.

Since all of the solenoids are in series with the spring, the entire force transmitted through the spring must be carried by each solenoid. For the ARG application, the imbalance force at the rail/roller interface with 1000 lbs. of imbalance load is approximately 145 lbs. To this static imbalance force, about 12% must be added to handle worst case acceleration profiles, plus the worst case dynamic force provided by the vibration magnet, which corresponds to the worst case additional spring compression with worst case side-to-side rail deviation. For the ARG application, this total force amounts to approximately 210 lbs.

In an ordinary magnetic actuator, supplying these static holding forces across a gap of this magnitude (assuming that the spring constant is the same as the effective spring constant at the roller guide) would lead to very large magnet designs, which would be expensive in terms of weight and power consumption. In the case of the DLMA, however, each solenoid is operated at minimum gap, resulting in lower power consumption and smaller size.

Figure 18:
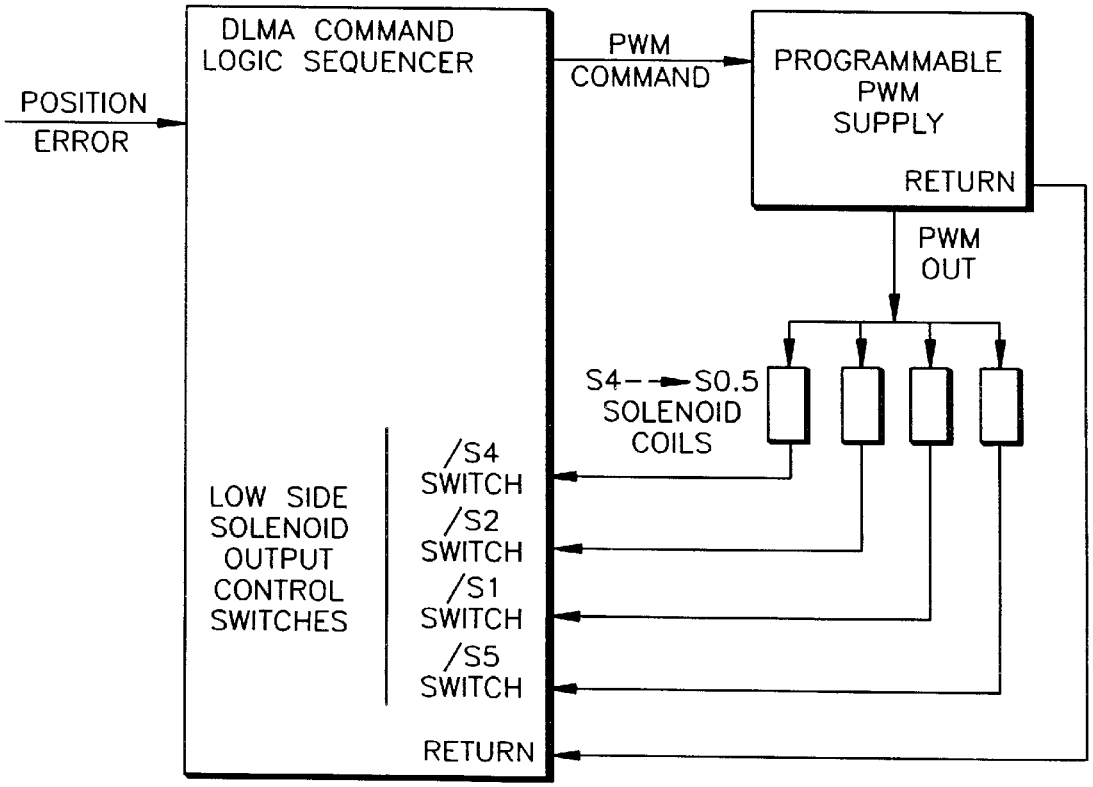
FIG. 18 shows a series DLMA control technique for the embodiment shown in FIG. 17.

FIG. 18 illustrates a command and control technique for the embodiment shown in FIG. 17 that may be implemented by an elevator car controller such as 20 shown in FIGS. 1–2. The supply voltage for the solenoids is a PWM rectangular waveform. When any given combination of solenoids is fully engaged, the reluctance of each activated solenoid is at maximum, and the DC current demand for a given PWM duty cycle is at minimum. If the stroke of the actuator needs to be changed, then the PWM duty cycle is set to 100%, and the new digital command is selected. The appropriate actuators engage and disengage, and then in the next update cycle, the PWM duty cycle is set to a new value based upon the following:

$$\text{PWM Duty Cycle}=A*\#\#\#\#,$$

where A is a constant which is a function of solenoid vendor holding voltage, and where #### is the binary stroke commanded to the actuator, corresponding to static holding force.

The solenoid logic command determination for the stacked series of DLMAs is substantially the same as that for the parallel DLMAs shown in FIG. 16. For example, first, the position reference is checked to determine if more or less centering force is required. If more is required, then the current actuator command is checked to determine if the command is at maximum (1111). If so, then no more force can be applied. If the command is not at maximum, then the PWM command is set to 100%, and the actuator command count is incremented by one.

In the case of less centering force required, the command count is checked to confirm that it is greater than minimum (0000). If so, then the PWM command is set to 100% and the actuator command is decremented by one. If the command is already 0000, then no less force can be applied on this roller; the centering force must be applied against the opposite roller.

After making the adjustment to the actuator command count, after a delay period, the Pulse Width Modulated command is set to A times the actuator command count, for the purpose of minimum power dissipation.

When the DLMA is commanded in this manner, the net change in spring length is 0.5 mm per update. For the ARG application, this granularity of centering control is adequate. The step change in the force through the spring can easily be compensated for by the vibration control magnets, in conjunction with acceleration feedback from the elevator car frame.

In summary, the stacked series of DLMAs provides the benefits of a magnetic actuation device, while circumventing the power consumption problem, by operating individual devices at minimum gap. Minimum power is required for keeping the magnets from "ungluing" during dynamic events by commanding the PWM supply as a function of the total static force transmitted through the actuator, plus margin.

The implementation described here uses linear springs, the concept is equally applicable when applied to spiral springs and rotary solenoids.

Some drawbacks to the stacked series approach include the fact that there are mounting problems associated with keeping the stack aligned properly, and getting the heat dissipated by the solenoids out of the assembly. In addition, each solenoid must carry the full force transmitted by the stack, which drives up the size of all the solenoids. Finally, the total amount of force delivered by each solenoid is limited due to series preloading effects.

Since all of the solenoids are in series with its spring, the entire force transmitted through each spring must be carried by each solenoid. For the Active Roller Guide application, the imbalance force at the rail/roller interface with 1000 lbs. of imbalance load is approximately 145 lbs. To this static imbalance force, about 12% must be added to handle worst case acceleration profiles, plus the worst case dynamic force provided by the electromagnet for vibration control, which corresponds to the worst case additional spring compression with worst side-to-side rail deviation. For the Active Roller Guide application, this total force amounts to approximately 210 lbs.

Although the present invention has been described and discussed herein with respect to one or more embodiments, other arrangements or configurations are possible which do not depart from the spirit and scope hereof. Hence, the present invention is deemed limited only by the appended claims and the reasonable interpretation thereof.

What is claimed is:

1. A roller guide assembly for controlling the position of an elevator car in relation to guide rails of an elevator hoistway in an elevator system, comprising:

at least one solenoid means, responsive to a solenoid centering control signal from an elevator car controller containing information about a combined solenoid and electromagnet centering control force, for providing at least one solenoid centering control force; and at least one electromagnet means, responsive to an electromagnet centering and vibration control signal from the elevator car controller containing information about the combined solenoid and electromagnet centering control force, for providing at least one electromagnet centering and vibration control force;

wherein the combined solenoid and electromagnet centering control force to position the elevator car in relation to the guide rails is a counterbalancing force including a combination of the solenoid centering control force and the electromagnet centering and vibration control force.

2. A roller guide assembly according to claim 1, wherein said at least one solenoid means further comprises at least one coil spring that responds to the at least one solenoid centering control force, for providing at least one coil spring force for adjusting the position of the elevator car in relation to the guide rails of the elevator hoistway.

3. A roller guide assembly according to claim 1, wherein said at least one electromagnet means provides said at least one electromagnet centering and vibration control force to control the vibration between the roller of the elevator car and a guide rail of the elevator hoistway during the control of the position of the elevator car in relation to the guide rails of the elevator hoistway.

4. A roller guide assembly according to claim 1, wherein the control of the position of the elevator car in relation to the guide rails of the elevator hoistway includes side-to-side and front-to-back centering control.

5. A roller guide assembly according to claim 1, wherein the solenoid centering control signal and the electromagnet centering and vibration control signal includes information about the position and/or acceleration of the elevator car in relation to the guide rails of the elevator hoistway.

6. A roller guide assembly according to claim 1, wherein said at least one electromagnet centering and vibration control force provides a fine adjustment of the position of the elevator car in relation to the guide rails of the elevator hoistway; and wherein said at least one solenoid centering control force provides a coarse adjustment of the position of the elevator car in relation to the guide rails of the elevator hoistway.

7. A roller guide assembly according to claim 1, wherein said at least one solenoid means further comprises a plurality of solenoids, each for separately providing a respective solenoid force for adjusting the position of the elevator car in relation to the guide rails of the elevator hoistway.

8. A roller guide assembly according to claim 7, wherein each of the plurality of solenoids separately provides a respective substantially equal solenoid force.

9. A roller guide assembly for an elevator system having an elevator car controller to control the position of an elevator car in relation to guide rails of the elevator hoistway and to control the vibration of a guide wheel of the elevator car and a guide rail of the elevator hoistway, comprising:

a solenoid, responsive to a solenoid centering control signal from an elevator car controller containing information about a combined solenoid and electromagnet centering control force, for providing a solenoid centering control force;

a coil spring, responsive to the solenoid centering force, for providing a coil spring centering control force to position the elevator car in relation to the guide rails of the elevator hoistway; and at least one electromagnet, responsive to the elevator car electromagnet centering and vibration control signal from the elevator car controller containing information about the combined solenoid and electromagnet centering control force, for providing at least one electromagnet centering and vibration control force to control the centering and vibration between the guide wheel of the elevator car and the guide rail of the elevator hoistway;

wherein the combined solenoid and electromagnet centering control force to position the elevator car in relation to the guide rails is a counterbalancing force including a combination of the solenoid centering control force and the electromagnet centering and vibration control force.

10. A roller guide assembly for an elevator system having an elevator car controller to control the position of an elevator car in relation to guide rails of the elevator hoistway and to control the vibration of a guide wheel of the elevator car and a guide rail of the elevator hoistway, comprising:

a solenoid, responsive to a solenoid control signal from the elevator car controller, for providing a solenoid force;

a coil spring, responsive to the solenoid force, for providing a coil spring force to control the position of the elevator car in relation to the guide rails of the elevator hoistway; and at least one electromagnet, responsive to the elevator car control signal, for providing at least one electromagnet force to control the vibration between the guide wheel of the elevator car and the guide rail of the elevator hoistway and to control the position of the elevator car in relation to the guide rails of the elevator hoistway;

wherein said coil spring is a linear coil spring having a spring length and a spring constant Ks, responsive to the coil spring force, for providing a variable linear coil spring force that depends on the spring length and the spring constant Ks for controlling the position of the elevator car in relation to the guide rails of the elevator hoistway.

11. A roller guide assembly according to claim 10, wherein the control of the position of the elevator car in relation to the guide rails of the elevator hoistway includes side-to-side and front-to-back centering control.

12. A roller guide assembly according to claim 11, wherein said roller guide assembly further comprises a plurality of solenoids, each for separately providing a respective solenoid force for adjusting the position of the elevator car in relation to the guide rails of the elevator hoistway wherein said roller guide assembly further comprises a plurality of coil springs, each separately responsive to the respective solenoid force, each for providing a respective coil spring force to control the position of the elevator car in relation to the guide rails of the elevator hoistway.

13. A roller guide assembly according to claim 12, wherein each of the plurality of solenoids separately provides a respective substantially equal solenoid force.

14. A roller guide assembly according to claim 12, wherein the guide wheel is arranged on a pivot axis mounted on an elevator car; and wherein the variable linear coil spring force opposes the electromagnet force about the pivot axis.

15. A roller guide assembly according to claim 10, wherein the solenoid is a digital linear magnetic actuator.

16. A roller guide assembly according to claim 10, wherein the roller guide assembly comprises:

a plurality of solenoids, each having a respective piston for moving with a corresponding adjustable stroke, responsive to an associated solenoid control signal from the elevator car controller, for providing a respective adjustable stroke force; and a plurality of linear coil springs, each having a respective spring length and a respective spring constant Ks, each responsive to the respective adjustable stroke force, for providing a corresponding variable linear coil spring force that depends on the respective spring length and the respective spring constant Ks for controlling the position of the elevator car in relation to the guide rails of the elevator hoistway.

17. An active roller guide assembly according to claim 16, wherein each pair of one of the plurality of solenoids and one of the plurality linear coil springs provides the corresponding variable linear coil spring force with substantially the same force.

18. An elevator system for controlling the position of an elevator car in relation to guide rails of an elevator hoistway, comprising:

an elevator car control, responsive to a sensed elevator car signal having information about the position of the elevator car in relation to the guide rails of the elevator hoistway, for providing a solenoid centering control signal containing information about a combined solenoid and electromagnet centering control force, and further providing an electromagnet centering and vibration control signal from the elevator car controller also containing information about the combined solenoid and electromagnet centering control force;

at least one solenoid means, responsive to the solenoid centering control signal, for providing at least one solenoid force; and at least one electromagnet means, responsive to the electromagnet centering and vibration control signal, for providing at least one electromagnet centering and vibration control force;

wherein the combined solenoid and electromagnet centering control force to position the elevator car in relation to the guide rails includes a combination of the solenoid centering control force and the electromagnet centering and vibration control force.

19. An elevator system according to claim 18, wherein the at least one solenoid means includes at least one solenoid connected to a corresponding coil spring.

20. An elevator system according to claim 18, wherein the solenoid centering control signal and the electromagnet centering and vibration control signal includes information about the position and/or acceleration of the elevator car in relation to the guide rails of the elevator hoistway.

21. An elevator system according to claim 18, wherein the solenoid centering control signal and the electromagnet centering and vibration control signal includes information about the side-to-side centering control and front-to-back centering control of the position of the elevator car in relation to the guide rails of the elevator hoistway.

* * * * *